US005678130A

United States Patent [19]

Enomoto et al.

[11] Patent Number: 5,678,130

[45] Date of Patent: Oct. 14, 1997

[54] DEVELOPING APPARATUS INCLUDING A CONTROL FUNCTION FOR APPLIED PERIODIC DEVELOPING BIAS FIELD

[75] Inventors: Naoki Enomoto; Haruo Fujii; Hiroshi Sasame; Motoi Katoh, all of Yokohama; Tatsuya Kobayashi, Sohka; Masao Nakano, Kamakura; Kazuhisa Kemmochi, Hachiohji; Tetsuya Kobayashi, Kawasaki; Toshiaki Miyashiro, Ichikawa; Akihiko Uchiyama, Yokohama; Yoshiro Saito, Kawasaki, all of Japan

[73] Assignee: Canon Kabushiki Kaisha, Tokyo, Japan

[21] Appl. No.: 659,774

[22] Filed: May 3, 1996

Related U.S. Application Data

[63] Continuation of Ser. No. 127,593, Sep. 28, 1993, abandoned.

[30] Foreign Application Priority Data

Sep. 29, 1992 [JP] Japan ..... 4-283816

[51] Int. Cl.[6] ..... G03G 15/06

[52] U.S. Cl. ..... 399/55

[58] Field of Search ..... 355/245, 246, 355/265, 326 R, 327, 250, 251, 259, 261; 118/658, 657, 653; 399/285, 270, 55

[56] References Cited

U.S. PATENT DOCUMENTS

| | | | |
|---|---|---|---|
| 4,480,911 | 11/1984 | Itaya et al. | 355/251 |
| 4,482,243 | 11/1984 | Suzuki et al. | 355/246 |
| 4,553,500 | 11/1985 | Itaya et al. | 355/251 X |
| 4,600,295 | 7/1986 | Suzuki | 355/246 |
| 4,610,531 | 9/1986 | Hayashi et al. | 355/246 |
| 4,789,878 | 12/1988 | Endo et al. | 355/271 |
| 4,814,834 | 3/1989 | Endo et al. | 355/208 |
| 4,887,102 | 12/1989 | Yoshikawa et al. | 355/246 X |
| 4,989,044 | 1/1991 | Nishimura et al. | 355/251 |
| 5,032,852 | 7/1991 | Fujii et al. | 355/326 R |
| 5,066,979 | 11/1991 | Goto et al. | 355/245 X |
| 5,084,733 | 1/1992 | Katoh et al. | 355/251 |
| 5,187,523 | 2/1993 | Osawa | 355/251 |
| 5,202,729 | 4/1993 | Miyamoto et al. | 355/251 |
| 5,463,452 | 10/1995 | Inaba et al. | 355/246 |

*Primary Examiner*—S. Lee

*Attorney, Agent, or Firm*—Fitzpatrick, Cella, Harper & Scinto

[57] ABSTRACT

A developing apparatus includes a developer carrying member, disposed opposed to an image bearing member, for carrying a developer; a developing bias voltage applying source for applying a developing bias voltage having an oscillating component to the developer carrying member to develop an electrostatic latent image formed on the image bearing member; wherein $$10.0 \leqq T11/(T11+T12) \times 100 \leqq 90.0,$$

where T11 is a time period of a first step in which an electric field is formed in a direction for directing the developer from the developer carrying member toward the image bearing member in one cycle of the oscillating component of the developing bias voltage applied by the developing bias application source, and T12 is a time period of a third step between the first step and a second step in which an electric field is formed in a direction for directing the developer from the image bearing member to the developer carrying member, and T11/(T11+T12) is an inclination of the developing bias voltage.

12 Claims, 28 Drawing Sheets

| QUALITI \ AREAS | △ | ╲ | ╱ | ╳ | ⋯ | × | □ |
|---|---|---|---|---|---|---|---|
| EDGE CONCENTRATION | N | F | G | G | G | G | G |
| DENSITY | G | G | G | G | G | F | N |
| FOG | F | F | F | G | E | E | E |

E --- EXCELLENT
G --- GOOD
F --- NO PRACTICAL PROBLM
N --- NO GOOD

| QUALITI \ AREAS | △ △ △ △ △ | ▨ | ⋯ | × × × × × | □ □ □ □ □ |
|---|---|---|---|---|---|
| EDGE CONCENTRATION | N | F | G | G | G |
| DENSITY | G | G | G | F | N |

G --- GOOD
F --- NO PRACTICAL PROBLM
N ---NO GOOD

| AREAS / q/m | ※ | △ | □ | × | | | | | * |
|---|---|---|---|---|---|---|---|---|---|
| -6μc/g | N | N | N | N | F | F | F | F | G |
| -10μc/g | N | N | N | F | F | F | F | G | G |
| -14μc/g | N | N | F | F | F | F | G | G | G |
| -18μc/g --35μc/g | N | F | F | F | F | G | G | G | G |

G : NO EDGE CONCENTRATION
F : NO PRACTICAL PROBLM
N : EDGE CONCENTRATION

| q/m \ AREAS | ※ | △ | □ | × | | | | | * |
|---|---|---|---|---|---|---|---|---|---|
| -6μc/g -26μc/g | N | F | F | F | F | G | G | G | G |
| -29μc/g | N | N | F | F | F | F | G | G | G |
| -32μc/g | N | N | N | F | F | F | F | G | G |
| -35μc/g | N | N | N | N | F | F | F | F | G |

G : SUFFICIENT DENSITY
F : NO PRACTICAL PROBLM
N : INSUFFICIENT DENSITY

| AREAS / m/s | ※ | △ | □ | × | | | | | * |
|---|---|---|---|---|---|---|---|---|---|
| 1.5mg/cm² | N | N | N | N | F | F | F | F | G |
| 1.2mg/cm² | N | N | N | F | F | F | F | G | G |
| 0.9mg/cm² | N | N | F | F | F | F | G | G | G |
| 0.6mg/cm² OR LOWER | N | F | F | F | F | G | G | G | G |

G : NO EDGE CONCENTRATION

F : NO PRACTICAL PROBLM

N : EDGE CONCENTRATION

| AREAS / m/s | × × × × × × | △ △ △ △ △ △ | □ □ □ □ □ □ | × × × × × × | | | | | |
|---|---|---|---|---|---|---|---|---|---|
| 0.35mg/cm² OR ABOVE | N | F | F | F | F | G | G | G | G |
| 0.30mg/cm² | N | N | F | F | F | F | G | G | G |
| 0.25mg/cm² | N | N | N | F | F | F | F | G | G |
| 0.20mg/cm² | N | N | N | N | F | F | F | F | G |

G : SUFFICIENT DENSITY
F : NO PRACTICAL PROBLM
N : INSUFFICIENT DENSITY

DEVELOPING APPARATUS INCLUDING A CONTROL FUNCTION FOR APPLIED PERIODIC DEVELOPING BIAS FIELD

This application is a continuation of application Ser. No. 08/127,593 filed Sep. 28, 1993, now abandoned.

FIELD OF THE INVENTION AND RELATED ART

The present invention relates to a developing apparatus usable for visualizing (developing) an electrostatic latent image formed on an image bearing member in an image forming apparatus of an electrophotographic type or the like.

In an electrophotographic type image forming apparatus, an electrostatic latent image formed on an image bearing member is developed by a developing device into a visualized toner image.

Referring first to FIG. 9, there is shown a major part of an exemplary image forming apparatus having a conventional developing device.

The image forming apparatus is provided with a photosensitive drum 1 having a photosensitive layer of an organic photoconductive material (the image bearing member). In this example, the photosensitive drum 1 has a diameter of 30 mm, and rotates at a speed of 60 mm/sec in the direction indicated by an arrow during which it is uniformly primary-charged to −600 V by a primary charger disposed adjacent thereto. Subsequently, the photosensitive drum 1 is exposed to image information light by a light emitting element 4 such as a laser, LED or the like so that the potential of the exposed portion is changed to −100 V, by which an electrostatic latent image having an image portion is provided for receiving the toner at the exposed portion on the photosensitive drum 1. The electrostatic latent image formed on the photosensitive drum 1 is developed by a developing device disposed adjacent to the periphery of the photosensitive drum 1.

In this developing apparatus, a developing sleeve 2, an application roller 3 and an elastic blade 7 are provided in a developer container 6 containing non-magnetic toner as a developer. The developing sleeve 2 has a diameter of 16 mm, and is exposed in an opening that faces the photosensitive drum 1 for rotation in a direction indicated by an arrow. The application roller 3 is disposed to be contacted to a lower portion of the developing sleeve 2. The application roller 3 has a diameter of 8 mm, and rotates in a direction indicated by an arrow so that the non-magnetic toner in the container is rubbed and carried on the surface of the developing sleeve 2.

The developing sleeve 2 carries the toner to the developing position where the developing sleeve 2 faces the photosensitive drum 1. During the carrying action, the layer thickness of the toner is regulated by the elastic blade 7 so that a toner layer having a predetermined small thickness is applied and formed on the developing sleeve 2. The elastic blade is made of urethane material, or the like, and is disposed at an upper position of the opening of the container 6. It extends downwardly to be elastically contacted to the surface of the developing sleeve.

During the process up to this point, a thin layer of the toner on the developing sleeve 2 rubbed by the elastic blade 7, the application roller 3 and the developing sleeve 2 so as to be triboelectrically charged −6 μC/g—30 μC/g.

The photosensitive drum 1 and the developing sleeve 2 are disposed without contact from each other with a gap of 50–500 microns, typically 300 microns. Across the gap (SD gap) between the developing sleeve 2 and the photosensitive drum 1, a developing bias voltage is applied from the bias voltage source. The developing bias is in the form of a DC biased AC voltage having a frequency of 800–3500 Hz, an amplitude of 400–3000 V and a waveform integration average voltage Vdc of −50—550 V. This voltage produces a developing electric field.

As for the AC voltage, there are known a sine wave as shown in FIG. 10, a triangular wave as shown in FIG. 11, a saw tooth wave as shown in FIG. 12, a pulse wave as shown in FIG. 13, a bias waveform as shown in FIG. 14 in which an integration average Vdc is different from one half the maximum voltage of the wave form and which comprises a first peak (Vmax) application period in which an electric field is provided directing the toner from the developing sleeve 2 to the photosensitive drum 1, and a peak (Vmin) application period is provided for directing the toner from the photosensitive drum 1 to the developing sleeve 2 (hereinafter, the bias voltage will be called duty bias).

The charged toner on the developing sleeve 2 is transferred from the surface of the developing sleeve 2 to the surface of the photosensitive drum 1 by the force provided by the developing electric field in the developing zone, so that the electrostatic latent image on the photosensitive drum 1 is developed.

With the recent development of computer graphic technology, the image provided by the electrophotographic type image forming apparatus is desired to be of high quality.

However, when an electrostatic latent image of 5 mm square (5 mm×5 mm) is developed using the duty bias, a rectangular bias as the developing bias, the 5 mm square toner image G is not uniform as shown in FIG. 15, because the density at the trailing edge G is remarkably higher than the other portion (so-called edge concentration), and therefore, a uniform image is not formed. If the developing operation is carried out using a sine wave, rectangular wave or saw tooth wave, insufficient density of the image occurs.

As a method for increasing the image density, there are known a method in which an amplitude of an alternating component of the developing bias applied to the developing zone gap and a method in which a DC component is changed. However, if the amplitude of the alternating component of the developing bias is increased, or if the DC component is changed, spark discharge or the like may occur between the developing sleeve 2 and the photosensitive drum 1 (SD gap), and in addition, there is a liability of production of foggy background.

Conventionally, therefore, it has been difficult to satisfy the requirement for high quality image.

In the case of color image formation, different color toner images are overlaid, and therefore, the image quality is more deteriorated than in the monochromatic image if the images involve edge concentration or insufficient image density.

SUMMARY OF THE INVENTION

Accordingly, it is a principal object of the present invention to provide a developing device in which a developing bias applied to a developer carrying member during developing operation is regulated so that a high quality image without edge concentration or insufficient image density by the development is achieved without difficulty.

It is another object of the present invention to provide a developing apparatus capable of forming a high quality image in which a developing bias voltage applied to a developer carrying member during developing operation is regulated relative to a charge amount q/m per unit weight of the toner carried on the developer carrying member, so that the high quality image can be produced without edge concentration or insufficient density, because toner scattering or discharging does not occur.

It is a further object of the present invention to provide a developing apparatus in which a developing bias applied to a developer carrying member during the developing operation is regulated in relation to a mass m/s per unit area of a thin developer layer applied on the developer carrying member, so that a high quality image without edge concentration and insufficient density is achieved without toner scattering and discharging.

These and other objects, features and advantages of the present invention will become more apparent upon a consideration of the following description of the preferred embodiments of the present invention taken in conjunction with the accompanying drawings.

FIGS. and 13 and 14 illustrate a rectangular waveform of the developing bias voltage.

Figure 15:
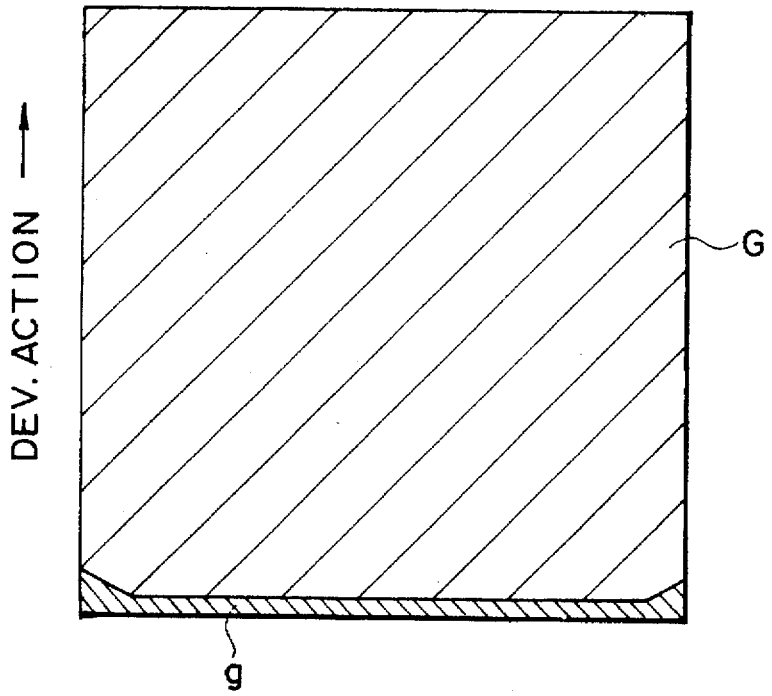

FIG. 15 illustrates edge concentration in a toner image.

Figure 16:
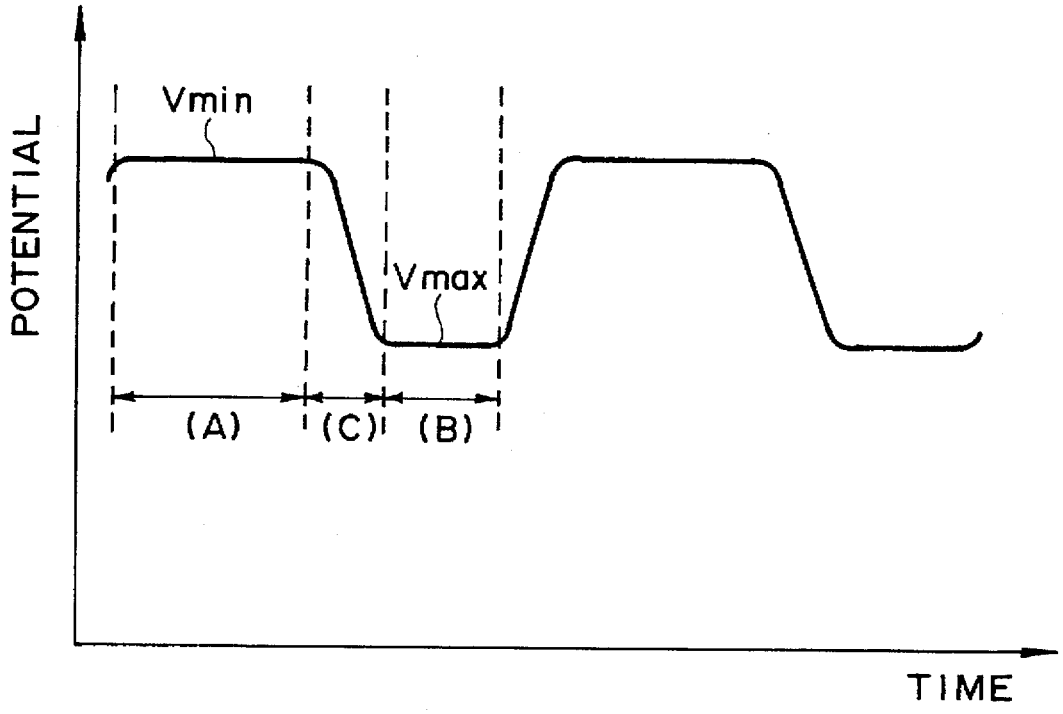

FIG. 16 illustrates a waveform of a developing bias voltage used in this invention.

Figure 17:
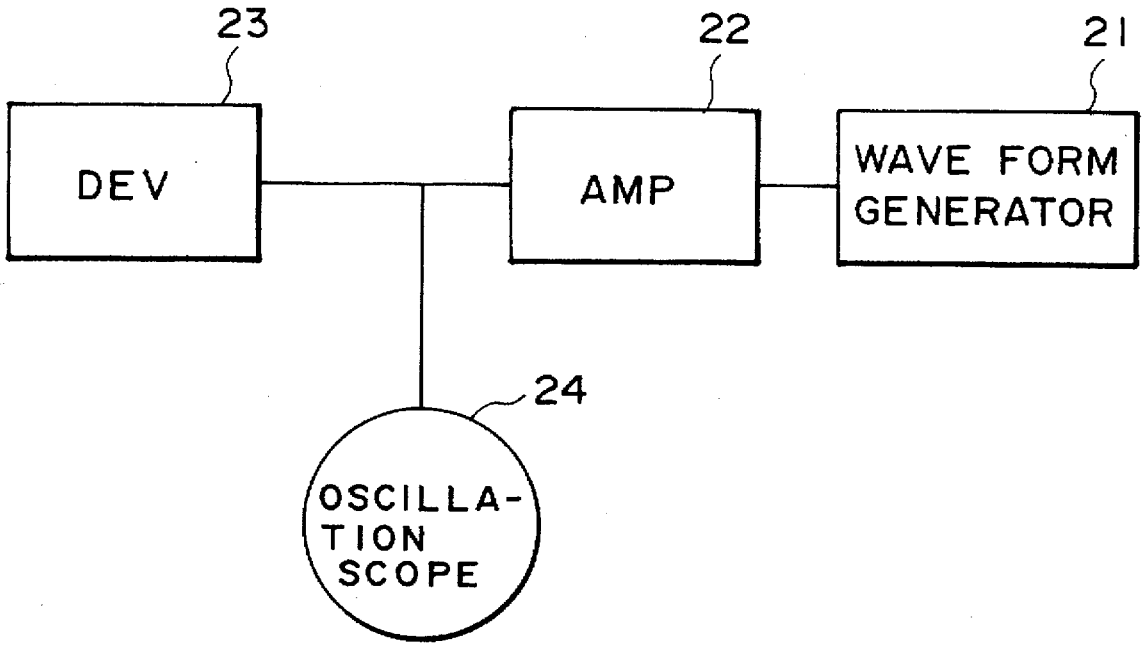

FIG. 17 is a block diagram of an apparatus used in experiments.

Figure 18:
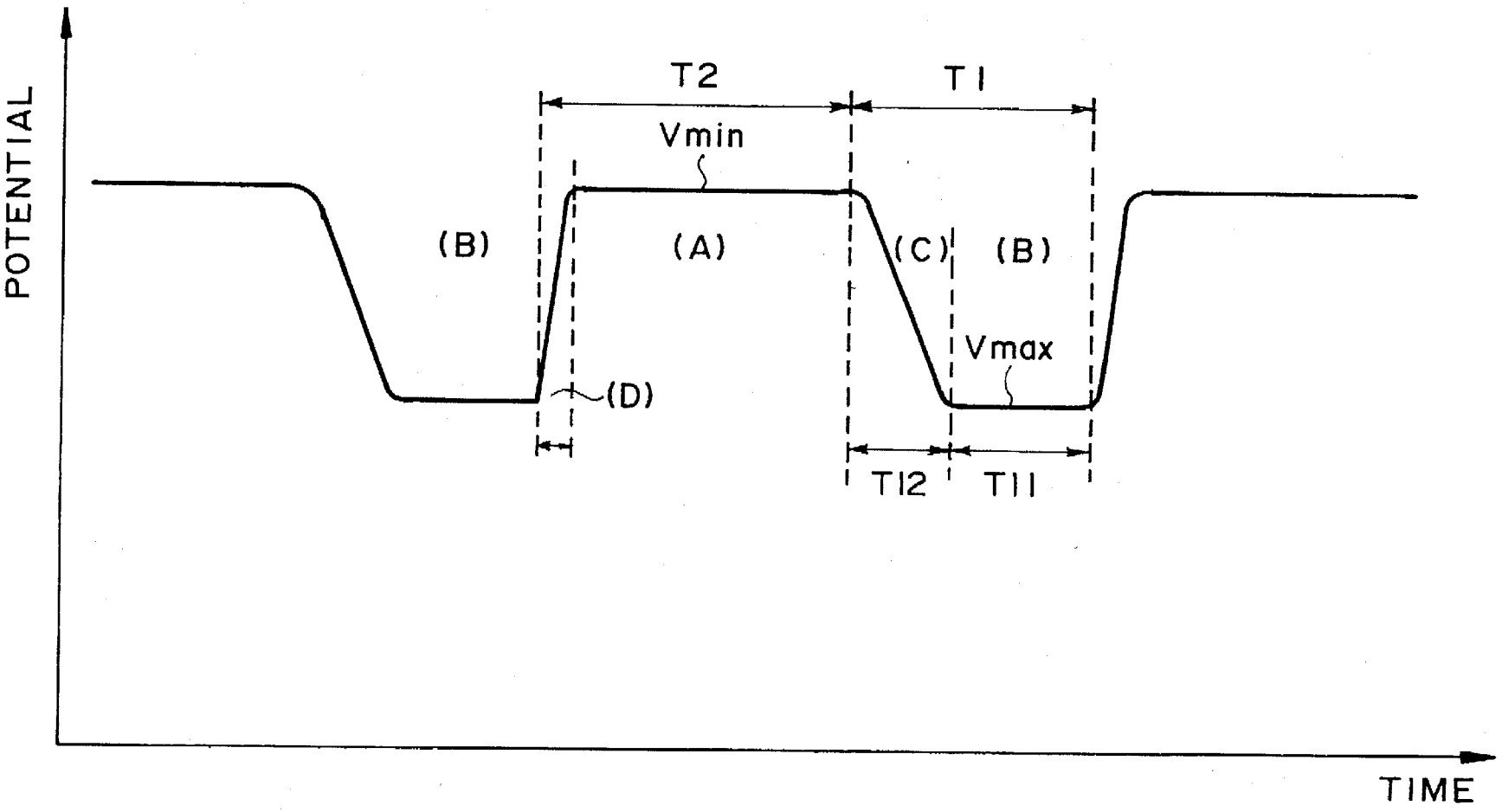

FIG. 18 illustrates each step in one period of an AC component of the developing bias voltage.

Figure 19:
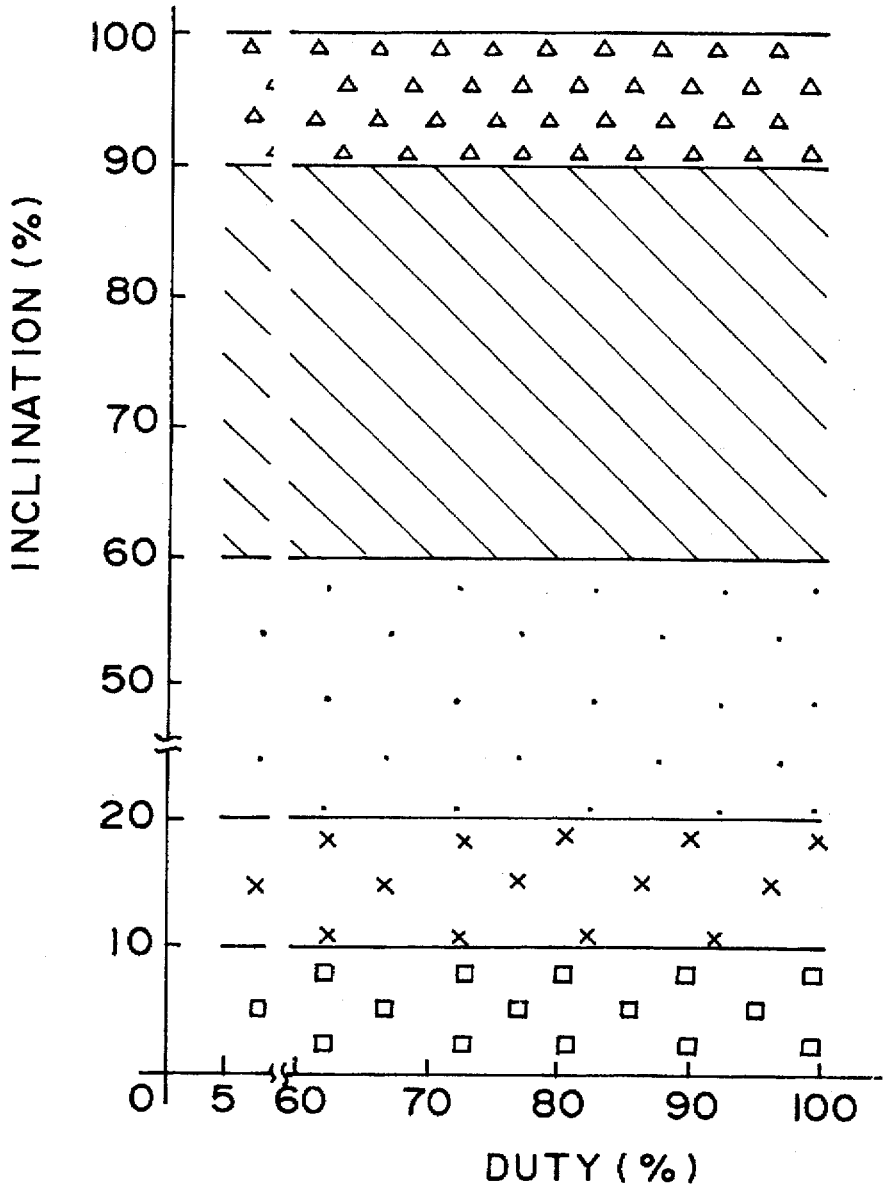

FIG. 19 shows a relationship among a duty percentage, an inclination percentage and a state of the image in an embodiment of the present invention.

Figure 20:
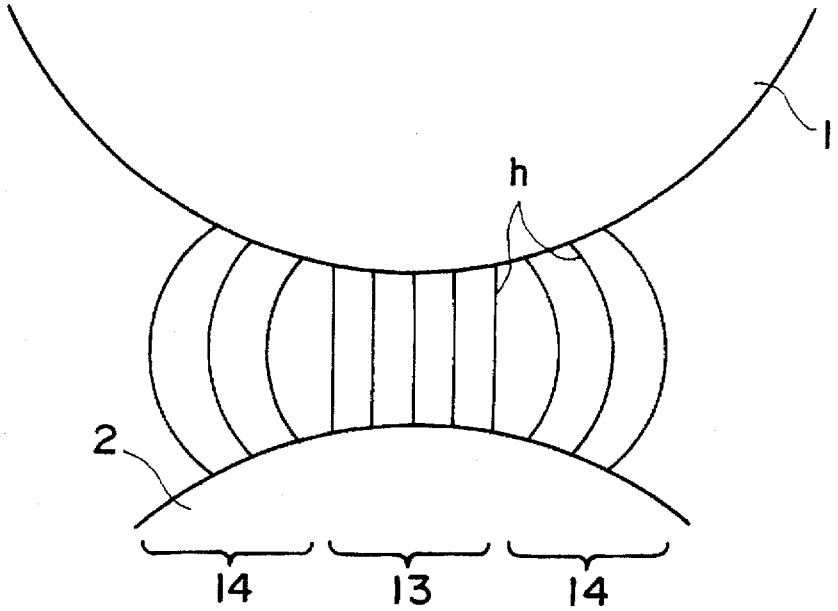

FIG. 20 shows electric lines of force between a photosensitive member and a developing sleeve.

Figure 21:
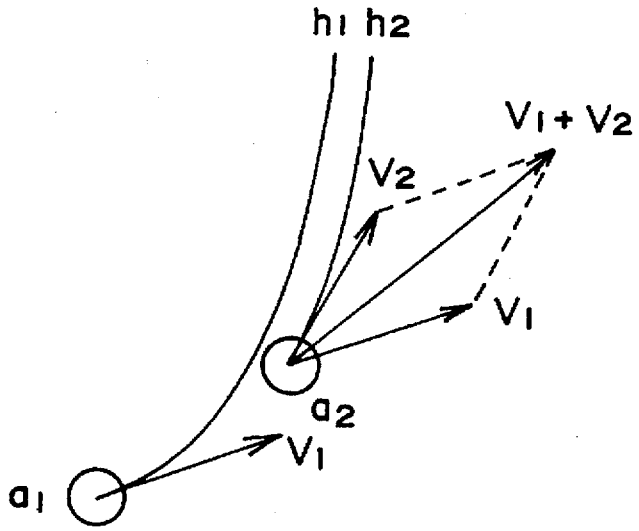

FIG. 21 illustrates movement of the toner due to the force of electric field at an end in a movement direction in the SD gap.

FIGS. 22–26 illustrate a mechanism of the edge concentration production.

Figure 27:
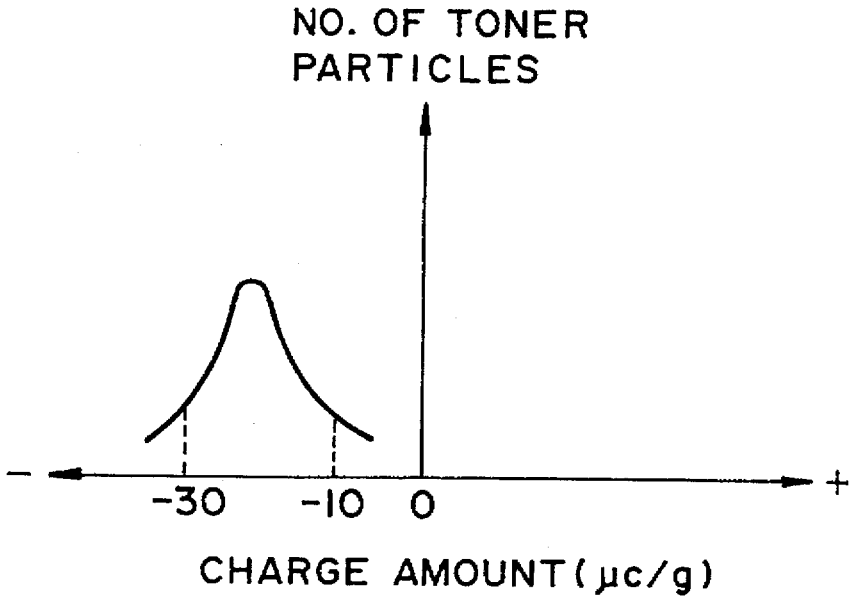

FIG. 27 illustrates distribution of the charge amount of the toner per unit weight.

Figure 28:
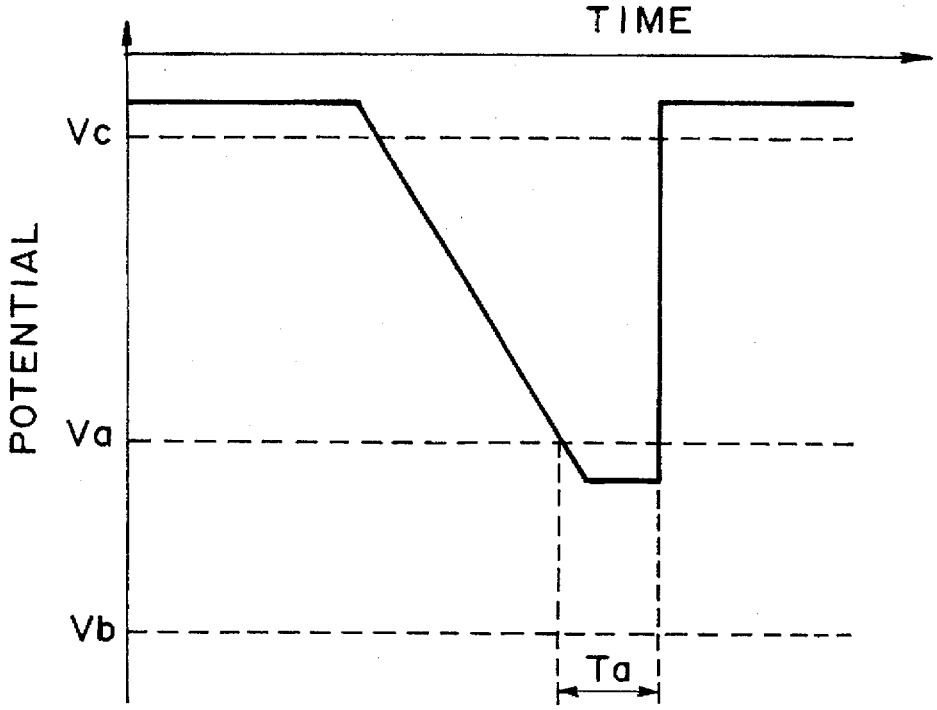

FIG. 28 shows a moving period of a toner to a photosensitive member at an end, in a movement direction, between the photosensitive member and the developing sleeve.

Figure 29:
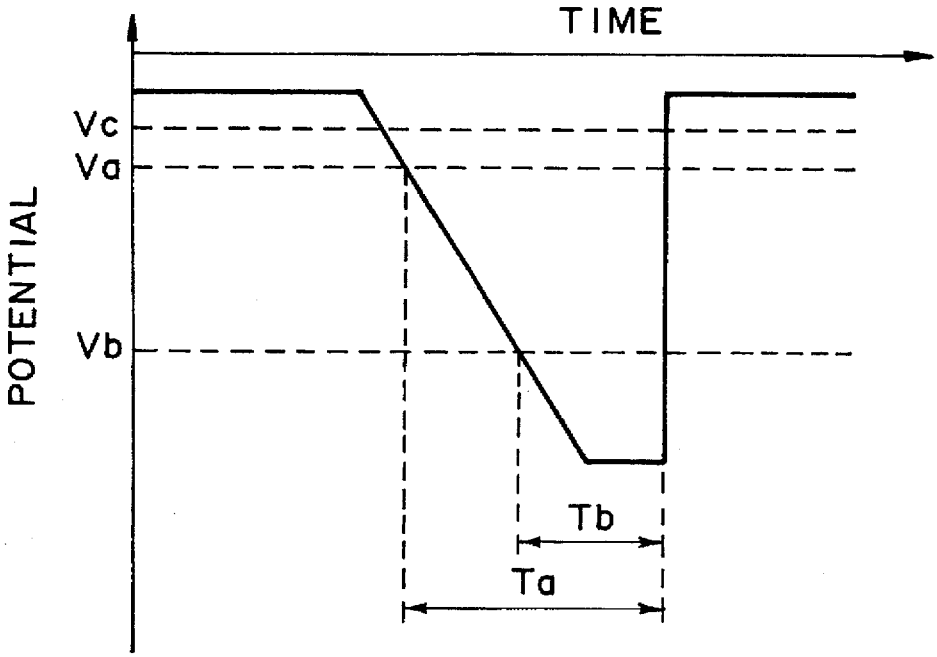

FIG. 29 shows a movement period of the toner to the photosensitive drum in a middle portion of the gap between the photosensitive member and the developing sleeve.

Figure 30:
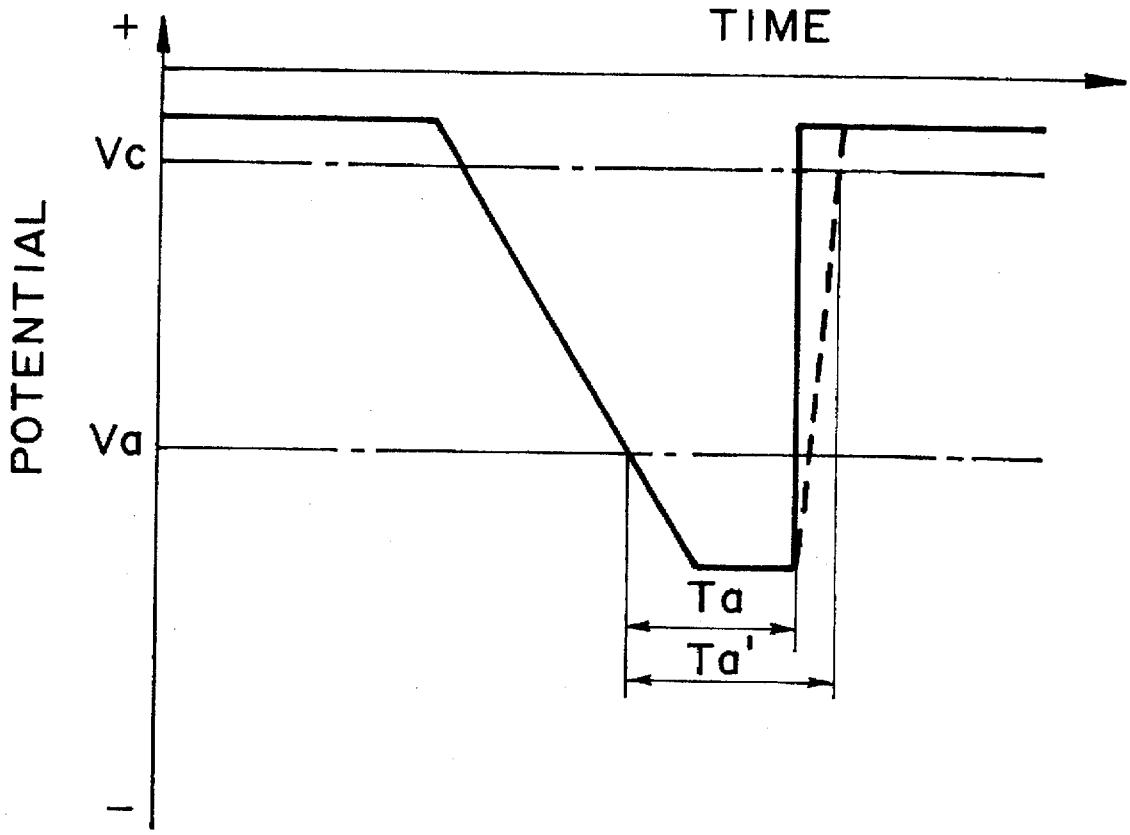

FIG. 30 illustrates a waveform at a rising portion of the developing bias voltage.

Figure 31:
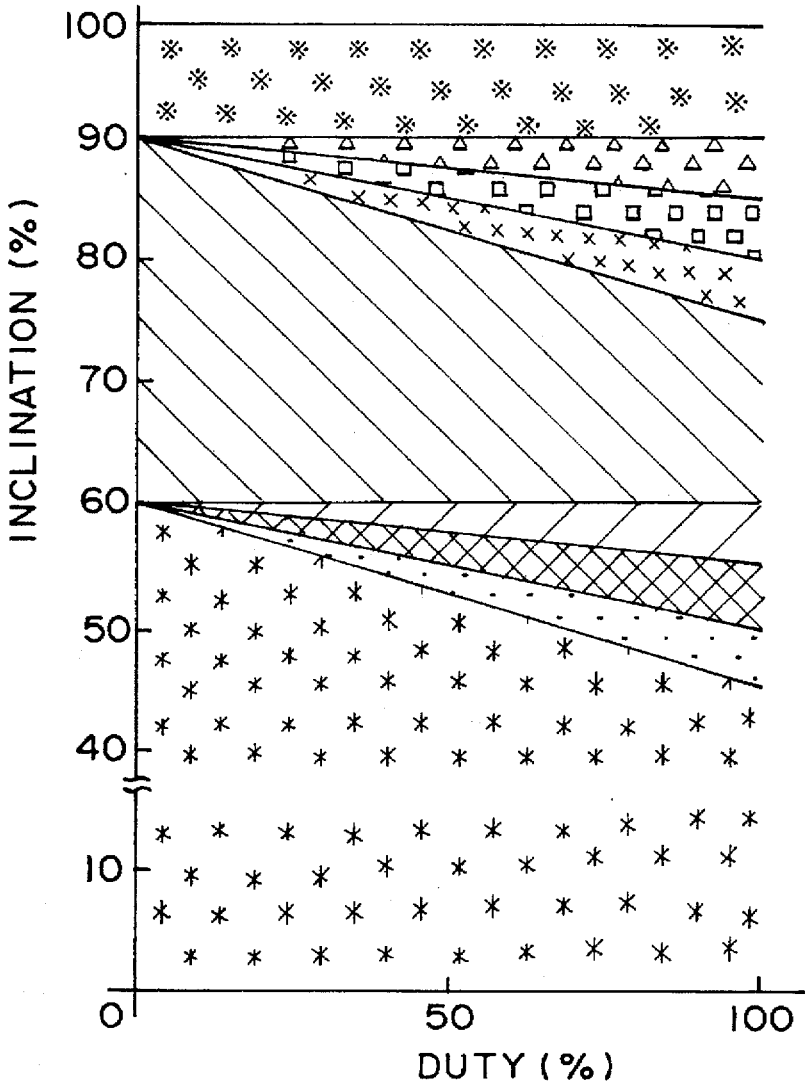

FIG. 31 shows a relationship among a duty percentage, an inclination percentage and an edge concentration, in a fifth embodiment of the present invention.

Figure 32:
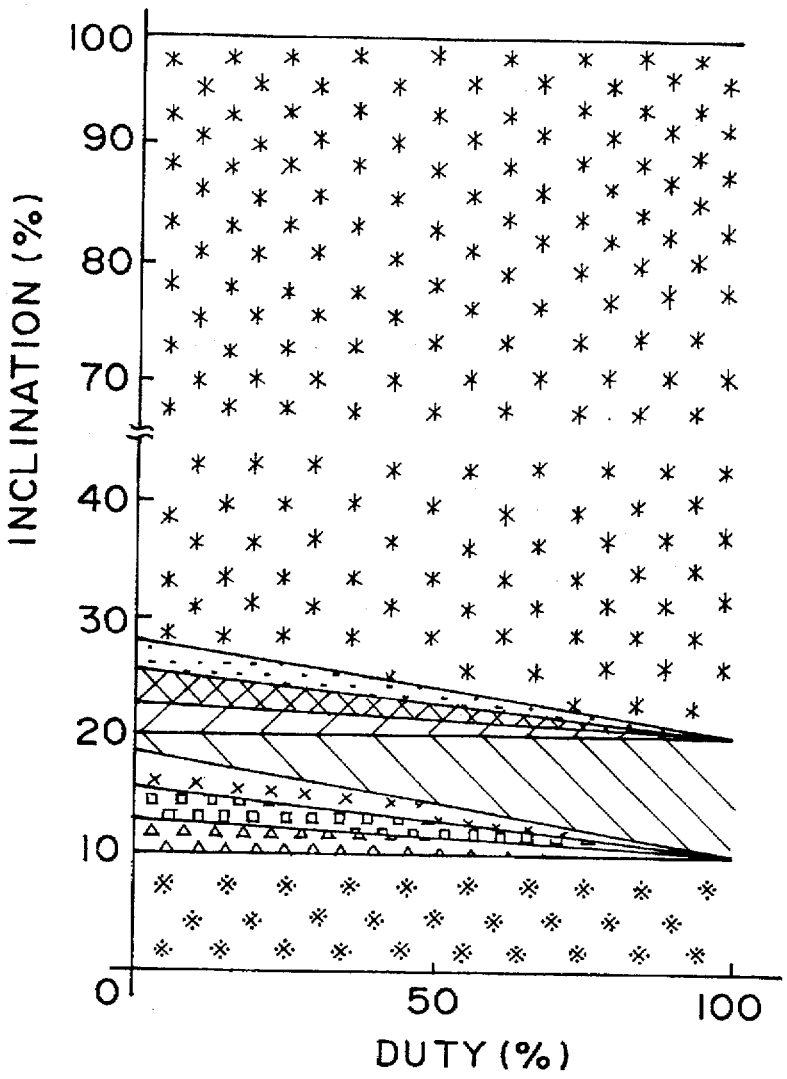

FIG. 32 shows a relationship among a duty percentage and an inclination percentage and an insufficient image density, in a fifth embodiment of the present invention.

Figure 33:
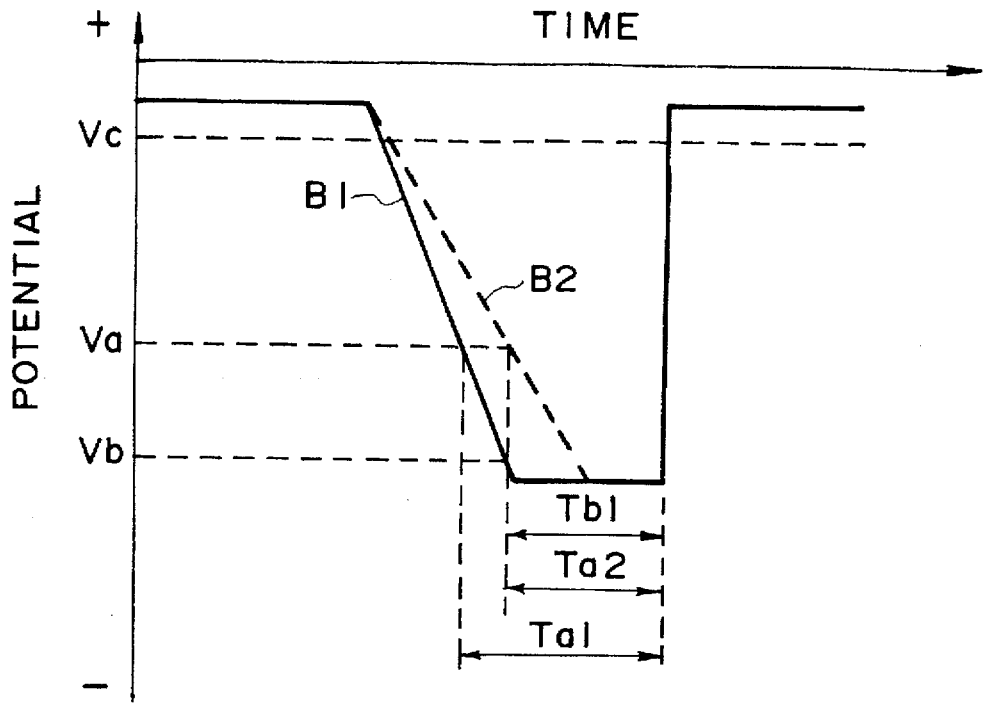

FIG. 33 shows a relationship between a moving period of the toner to the photosensitive member and a charge amount of the toner at an end, in a movement direction, in the gap between the photosensitive member and the developing sleeve.

Figure 34:
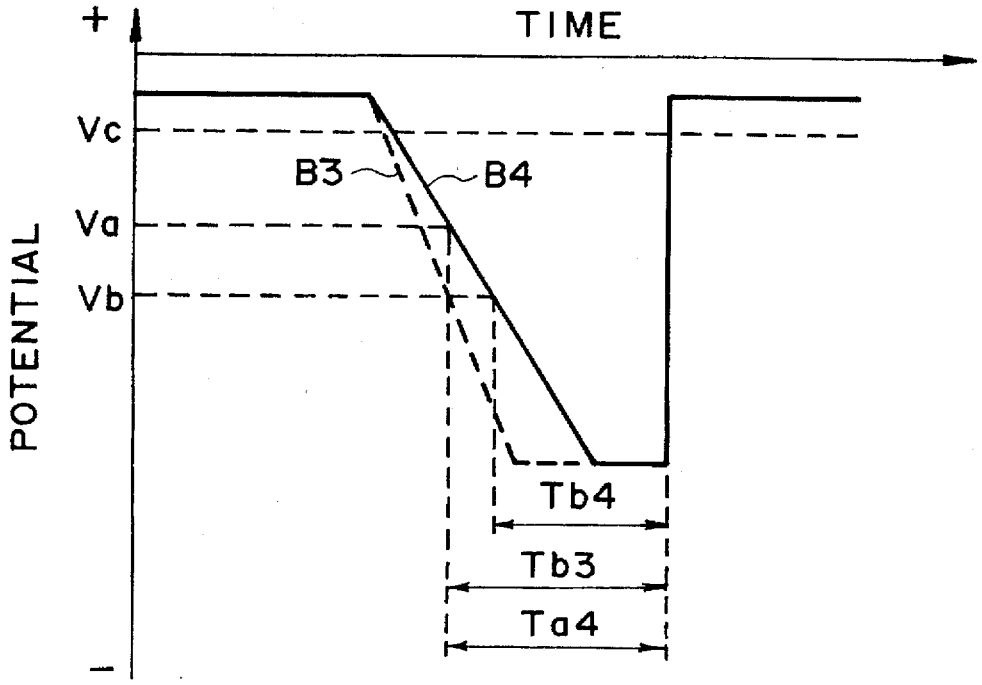

FIG. 34 shows a relationship between a movement period of the toner to a photosensitive member and a charge amount of the toner in the middle portion, in the movement direction, in the gap between the photosensitive member and the developing sleeve.

Figure 35:
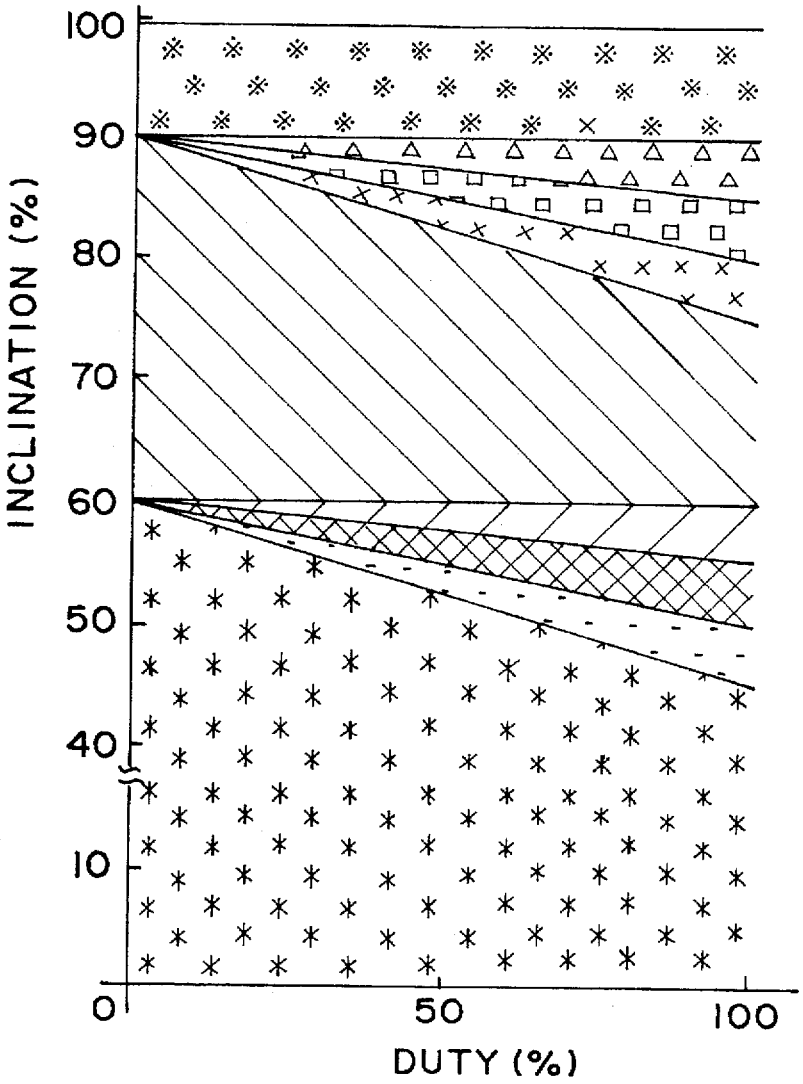

FIG. 35 shows a relationship among a duty percentage, an inclination percentage and an edge concentration, in an eighth embodiment.

Figure 36:
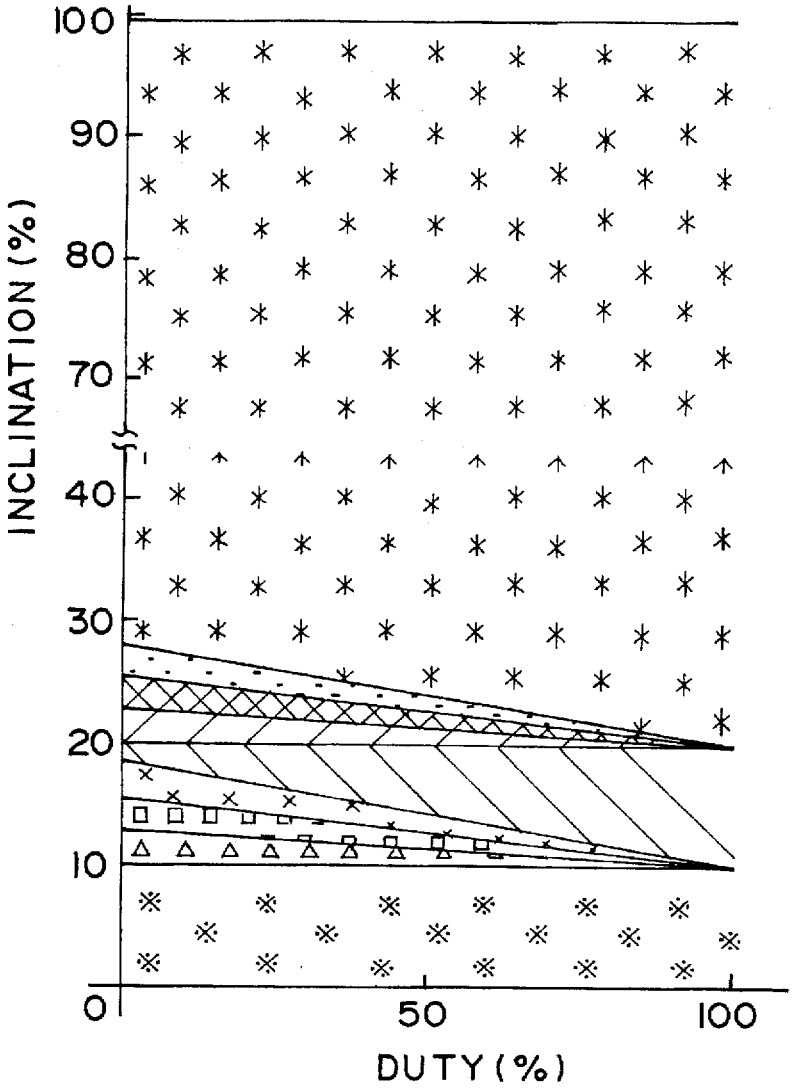

FIG. 36 shows a relationship among a duty percentage, an inclination percentage and an insufficient image density, in the fifth embodiment of the present invention.

Figure 37:
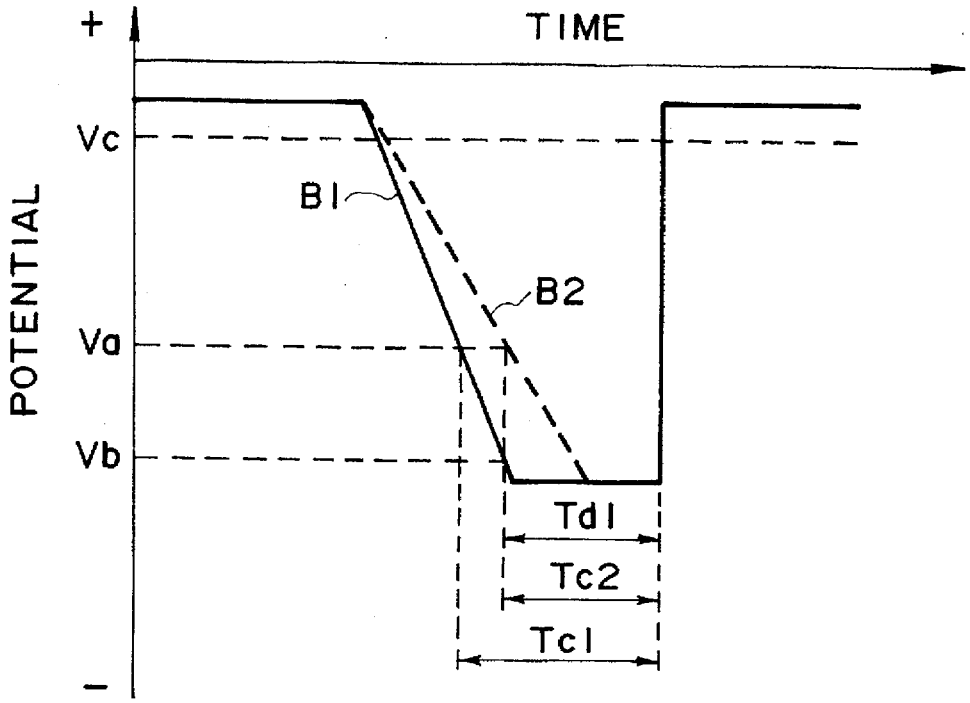

FIG. 37 shows a relationship between a moving period of the toner to the photosensitive member and a toner application amount at an end, in a movement direction, in the gap between the photosensitive member and the developing sleeve.

Figure 38:
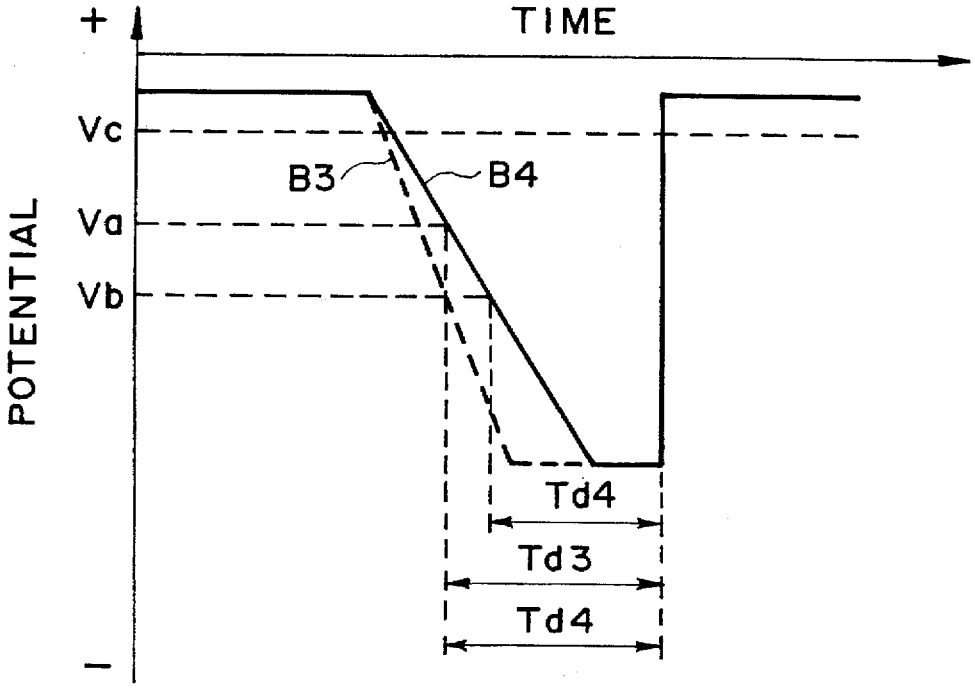

FIG. 38 shows a relationship between a moving period of the toner to the photosensitive member and a toner application amount in a middle portion, in the movement direction in the gap between the photosensitive member and the developing sleeve.

DESCRIPTION OF THE PREFERRED EMBODIMENTS

Various investigations have been carried out by the inventors for the purpose of providing good images without edge concentration and insufficient image density. As a result, the good images Without the edge concentration and the insufficient image density, could be provided in the following manner. As show in FIG. 16, a falling part of an AC component of the developing bias voltage (regulated falling bias voltage) is regulated (C). The falling voltage appears in a period from a toner transfer step (A) with potential of Vmin in which an electric field is formed in a direction to direct the toner from a photosensitive drum to the developing sleeve and a back-transfer step (B) with the potential of Vmax in which an electric field is formed in a direction to direct the toner from the developing sleeve to the photosensitive drum.

Referring to FIG. 17, the experiments carried out by the inventors will be described. A waveform generator 21 is connected to a developing device 23 through an amplifier 22, and the developing bias voltage waveform provided by the generator 21 is monitored by an oscilloscope 24 connected between the amplifier 22 and the developing device 23. While it is thus being monitored, a developing bias voltage is produced and applied to the developing device 23, to effect the developing operation. The structure of the developing device 23 is similar to the conventional developing apparatus shown in FIG. 9.

As shown in FIG. 18, in one period of an alternating component of the developing bias voltage, the rising step between the transfer step (B) and the back-transfer step (A) is (D). A sum of the time periods of the steps (A) and (D) is T2, and a sum of the time periods of the steps (B) and (C) T11 and T12 is T1. The duty percentage (%)=T1/(T1+T2) ×100, and an inclination percentage (%)=T11/T1×100=T11/(T11+T12)×100.

FIG. 19 shows a relationship between the inclination percentage and the duty percentage in one period of the AC component of the developing bias used in the developing operation in the experiments, and the occurrences of the edge concentration and the insufficient density of 5 mm square image. The duty percentage is changed between 5.0–95.0%, and the inclination percentage is changed between 0.5 and 99.5% in the respective duty percentages.

As will be understood from FIG. 19, for all duty percentages between 5.0 and 95.0% (more than 60% is mainly shown in the Figure, but the same applied to less than 60%), the edge concentration of the image lowers to the level of no practical problem, if the inclination percentage is set between 60.0 and 90.0%. In the range of 0.5 to 60.0% of the inclination percentage, the edge concentration is completely eliminated. When the inclination percentage is selected to be 10.0 to 20.0%, the insufficient density problem of the image lowers to the level of no practical problem. When it is set between 20.0–99.5%, sufficient densities are provided.

The reason for the above results are not completely clear, but they are considered as follows. First, the mechanism of the edge concentration production will be described.

Figure 22:
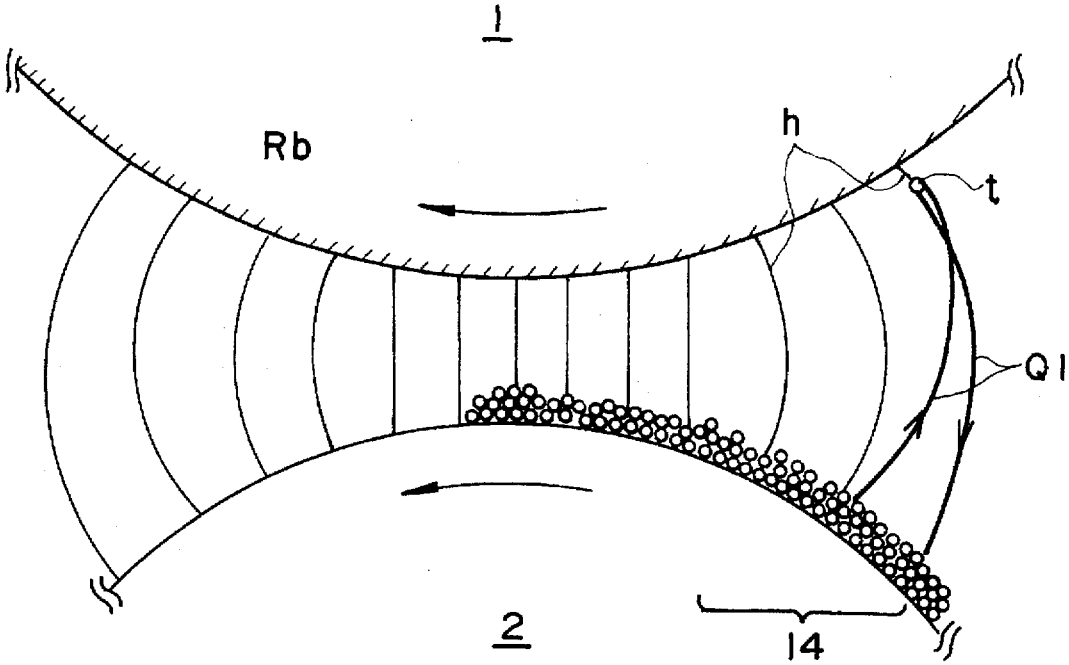

Referring to FIG. 20, there is shown in a cross-section electric lines of force in the SD gap between the developing sleeve supplied with the developing bias voltage and the photosensitive drum. As shown in FIG. 20, in the central portion 13 (in the peripheral direction of the SD gap), the electric lines of force h are substantially rectilinear. However, in the wider marginal portions 14 at the opposite ends, the electric lines of force h are curved. FIG. 21 schematically shows the movement directions of the toner particles by the force of the electric field in the end portions 14 in the SD gap when the surface of the photosensitive drum 1 faced to the developing sleeve 2 is in an image portion Rb (FIG. 22).

As shown in FIG. 21, a toner particle departed from the developing sleeve 2 has a velocity vector V1 in the tangential direction at a point $a_1$ on the curved electric force line $h_1$ at the end portion 14 of the SD gap. At the next instance when the toner comes to a point $a_2$, it has a velocity vector V2 in the tangential direction of the electric force line $h_2$ at the point $a_2$. Then, the toner is moved in a direction of the resultant vector (V1+V2) from the point $a_2$. Therefore, at the end portions 14 of the gap, as shown in FIG. 22, the toner t from the developing sleeve 2 does not move exactly along the electric lines of force, but it reciprocates with an outward deviation in the SD gap, as indicated by Q1 in FIG. 22.

Figure 23:
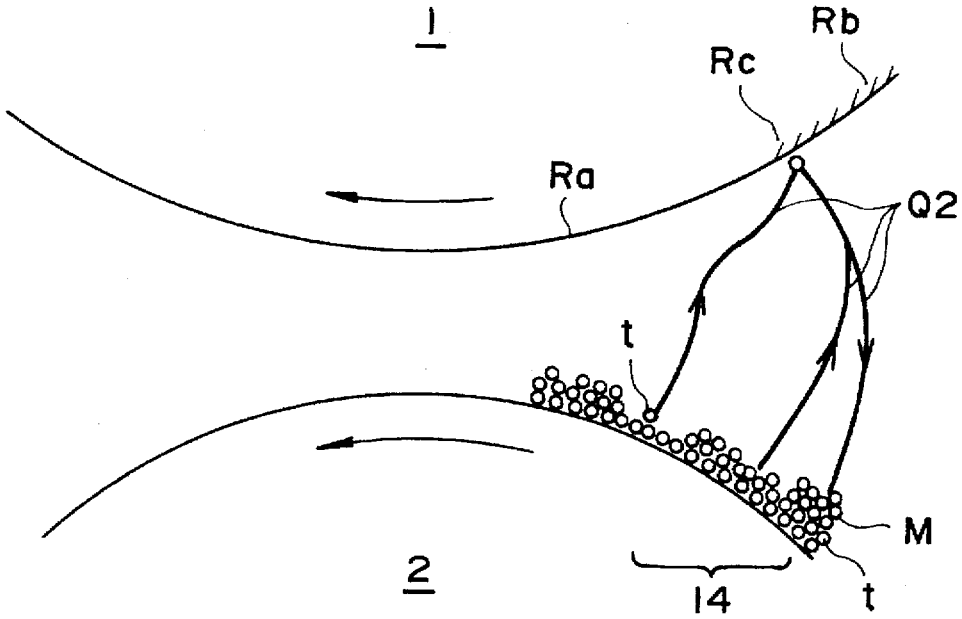

As shown in FIG. 23, a leading edge portion Rc which is a boundary between a non-image portion Ra of the photosensitive drum having the surface potential of −600 V and a continuing upstream image portion Rb having the surface potential of −100 V, comes to the end portion 14 of the SD gap where the electric lines of force are curved, the toner t on the developing sleeve 2 downstream of the image portion Rb, jumps along a line Q2 toward the image portion By this, the toner t is concentrated at the leading edge Rc of the image, and the concentrated toner returns to the upstream side of the developing sleeve 2. Thus, a large stagnation M of the toner t is produced at the upstream side of the developing sleeve 2 corresponding to the end portion 14 of the SD gap.

Figure 24:
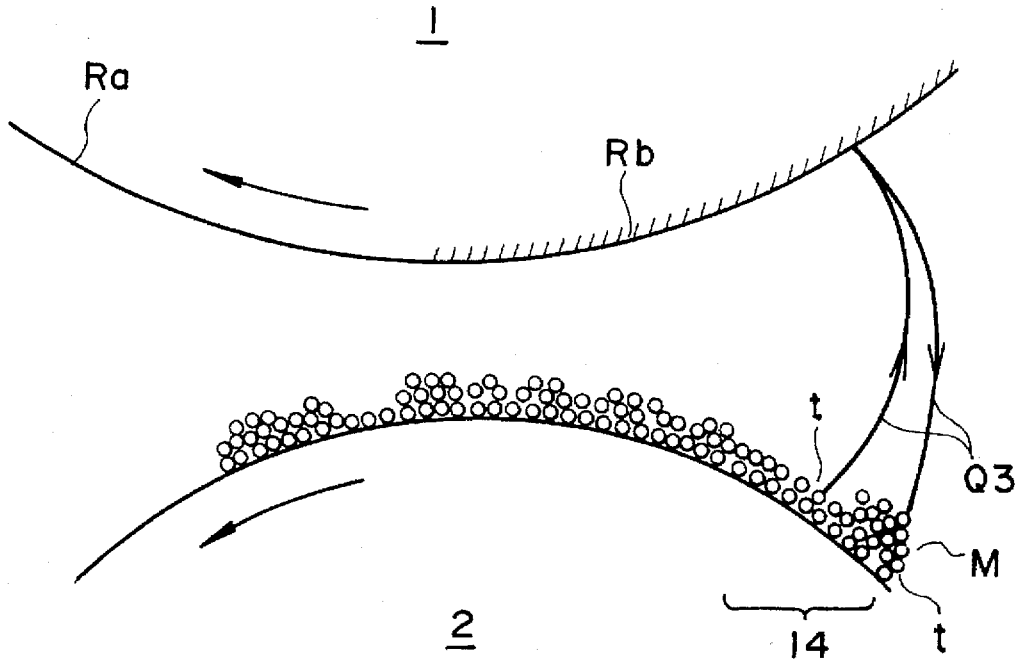

Subsequently, as shown in FIG. 24, the image portion Rb comes to the end 14 of the SD gap. At this time, the toner t on the developing sleeve 2 reciprocates with outward deviation as indicated by Q3. In this manner, despite the rotation of the developing sleeve 2, the toner stagnation M continues to be formed at a fixed position at the upstream side of the developing sleeve 2, so that the amount of accumulated toner t is increased.

Figure 25:
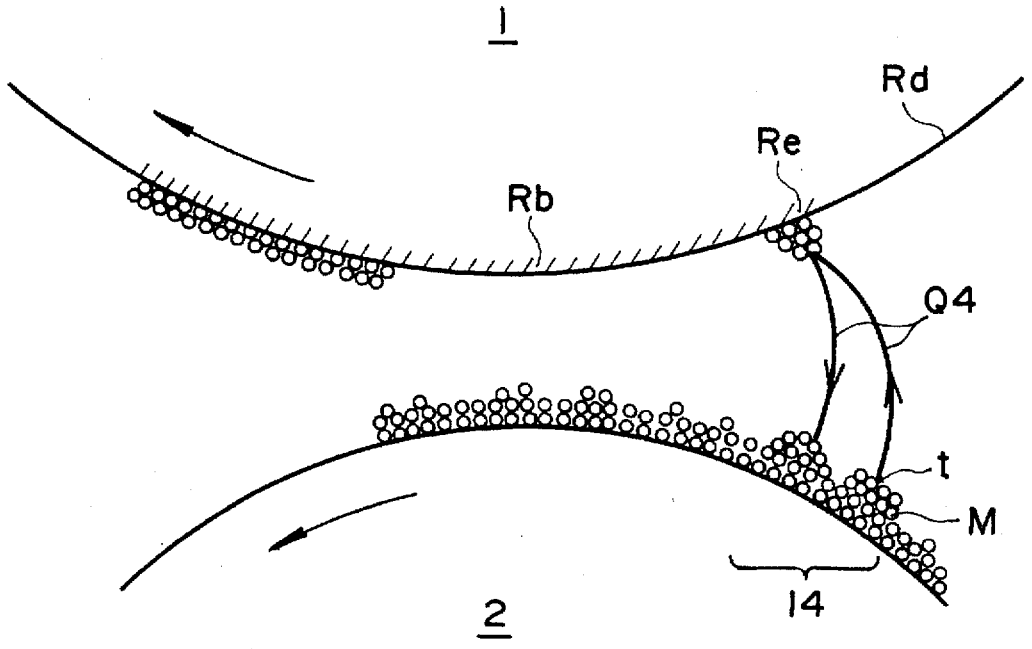

As shown in FIG. 25, when the trailing edge portion Re of the image which is a boundary between the image portion Rb of the photosensitive drum 1 and the continuing non-image portion Rd at the upstream side thereof comes to an end 14 of the gap SD by the rotation of the photosensitive drum 1, the electric field is concentrated on the trailing edge portion Re of the image with the result that the toner stagnation M on the developing sleeve 2 is attracted to the trailing edge portion Re of the image.

Thus, the toner in the toner stagnation M is deviated toward the downstream while reciprocating in the SD gap, passing through the SD gap by the movement of the image trailing edge portion Re.

Figure 26:
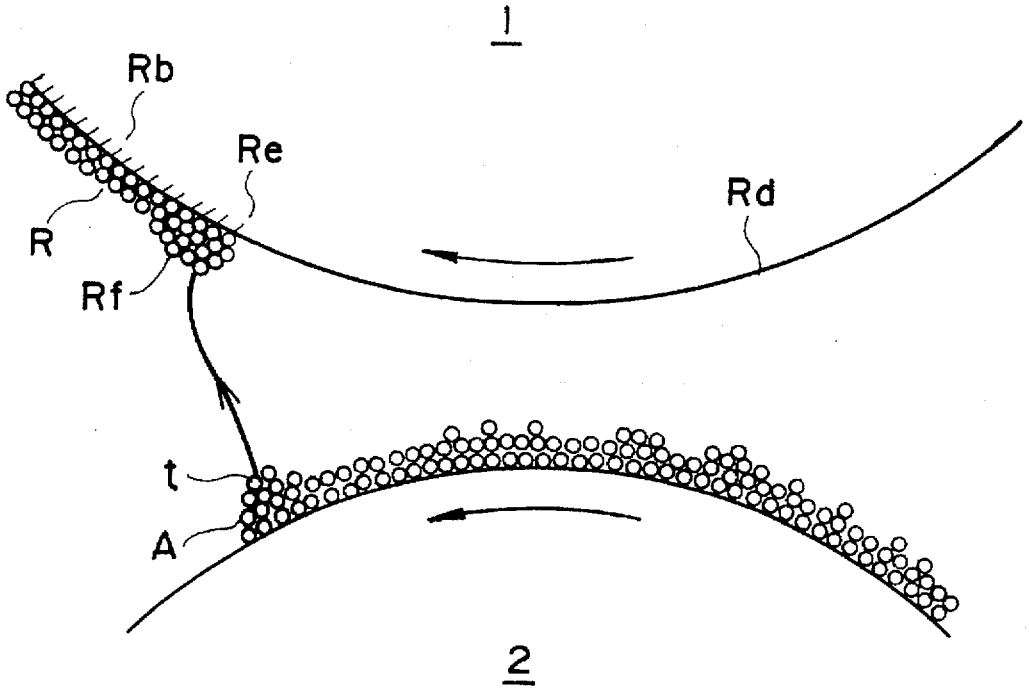

Finally, as shown in FIG. 26, at the point having a wide SD gap, the toner t in the toner stagnation M is deposited to the trailing edge of the image portion Rb. In this manner, the edge concentration Rf appears at the trailing edge of the toner image R on the photosensitive drum 1.

It will be understood from the foregoing analysis, that in order not to produce the edge concentration, it is effective to suppress the toner reciprocation at the end portion in the SD gap where the electric lines of force are curved. In order to provide sufficient image density in the non-contact type development, it is effective to sufficiently reciprocate the toner in the central portion of the SD gap.

Generally speaking, the toner receives a force Ft which is:

$$Ft \propto Qt \times Vs/dSD$$

where dSD is the gap of the SD gap, Vs is a potential of the developing Sleeve and Qt is a charge amount of the toner.

The toner moves by the force Ft provided by the electric field formed by the developing bias voltage.

The charge amount per unit weight of the toner on the developing sleeve, is not uniform but has a distribution, as shown in FIG. 27. The force received by the toner from the electric field and the mirror force received from the developing sleeve are different depending on the amount of the charge on each toner particle. Since toner having a small charge amount has a small mirror force, it can reciprocate in the SD gap even when the force applied by the electric field is small. In this case, however, the speed of the reciprocation is low because the acceleration speed is small. On the contrary, toner having a large amount of electric charge has a large mirror force, and therefore, it can not reciprocate in the SD gap unless the force applied by the electric field is strong enough. However, the speed of reciprocation is high because the acceleration is high.

FIG. 28 shows a relationship between a potential at the SD gap end of the developing sleeve supplied with the regulated falling bias voltage and a moving period of the toner from the developing sleeve toward the photosensitive drum. It shows the time period in which the toner departed from the developing sleeve 2 is moved toward the photosensitive drum 1 under the application of the regulated falling bias voltage at the end portion 14 of the SD gap where the gap is large, when the image portion of the photosensitive drum 1 is opposed to the developing sleeve 2.

In FIG. 28, when the potential of the developing sleeve becomes Va, the force provided by the electric field by the developing bias applied to a toner particle ta having a small amount of charge, becomes larger than the mirror force applied from the developing sleeve, with the result that the toner ta starts to move from the developing sleeve toward the photosensitive drum. However, since the potential of the developing sleeve becomes to be the same as the image portion potential Vc, and therefore, the moving period Ta of the toner ta is short.

In order that the force applied to the toner tb having a large charge amount applied by the electric field by the developing bias voltage exceeds the mirror force from the developing sleeve, the potential of the developing sleeve has to be Vb in the negative direction, and therefore, the toner tb is prevented from departing from the developing sleeve.

Therefore, irrespective of the amount of charge on the toner, the reciprocating motion can be suppressed for all of the toner particles in the wide SD gap portion, and therefore, the occurrence of edge concentration can be prevented.

FIG. 29 shows a relationship between a potential of the developing sleeve supplied with the regulated falling bias voltage at the middle portion of the SD gap and the time period of movement of the toner from the developing sleeve toward the photosensitive drum.

In FIG. 29, when the potential of the developing sleeve becomes Va, the force provided by the electric field by the developing bias applied to a toner particle ta having a small amount of charge, becomes larger than the mirror force applied from the developing sleeve, with the result that the toner ta starts to move from the developing sleeve toward the photosensitive drum. In this case, however, the time period from the start of the toter ta movement to the arrival of the potential Vc of the developing sleeve, is long, and therefore, the toner ta moving period Ta is long, so that it can reciprocate sufficiently the SD gap.

The toner tb having a large charge amount starts to move toward the photosensitive drum when the the potential of the developing sleeve becomes Vb, The moving period Tb of the toner tb is shorter than Ta, but the acceleration of the toner tb is larger than toner ta as described above, and therefore, the speed of the toner tb is higher than in the toner ta. For this reason, it can sufficiently reciprocate although the time period is short.

According to the regulated falling bias voltage, the reciprocating motion, in the SD gap, of the toner particles having different charge amounts is controlled by the falling period of the AC component of the developing bias voltage, so that toner reciprocation in the wide end portion of the SD gap can be prevented for all of the toner particles irrespective of the charge amount of on toner, and therefore, the toner can be sufficiently reciprocated in the narrow central portion of the SD gap. Accordingly, edge concentration and insufficient density can be prevented in the developed image.

In order to prevent edge concentration and a insufficient density of the image, according to an embodiment of the present invention, the following is satisfied (FIG. 19):

$$10.0 \leqq T11/T1 \times 100 \leqq 90.0$$

Further preferably, $$20.0 \leqq T11/T1 \times 100 \leqq 60.0$$

where T11/T1×100 is an inclination percentage which is a ratio of the time period T11 to the time period T1 (=T11+T12) in one period of the developing bias voltage.

In the foregoing, if a rising time period of the developing bias voltage is long, as shown by broken lines in FIG. 30, the moving period of the toner ta having a small charge amount changes from Ta to Ta', with the result that the toner reciprocates at the end portion of the SD gap, so that edge concentration occurs. Therefore, the rising period is preferably shorter.

The embodiments of the present invention will be described, although the present invention is not limited to them.

Embodiment 1

Figure 1:
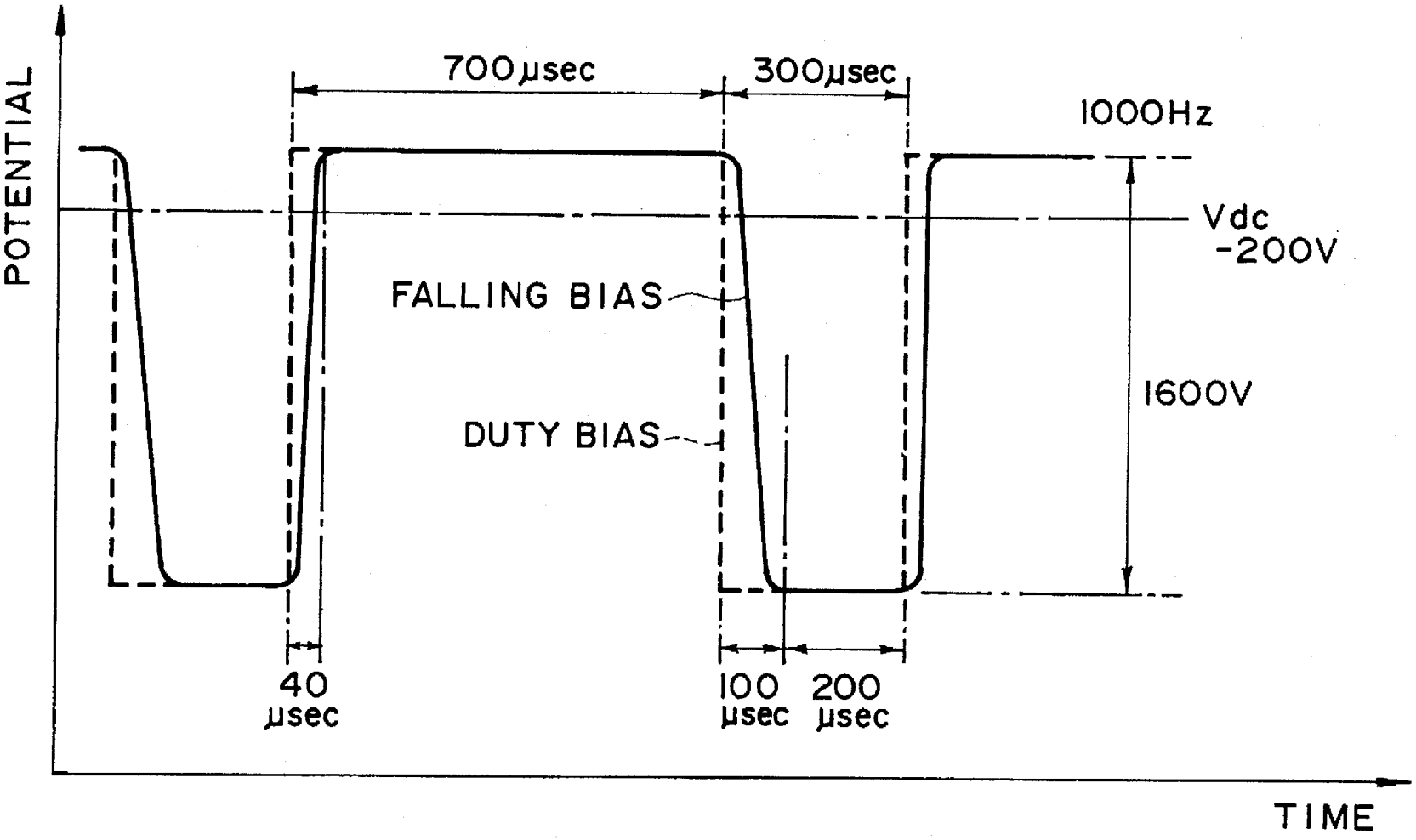
FIG. 1 illustrates an waveform of a developing bias voltage used in a first embodiment of the present invention.
Figure 9:
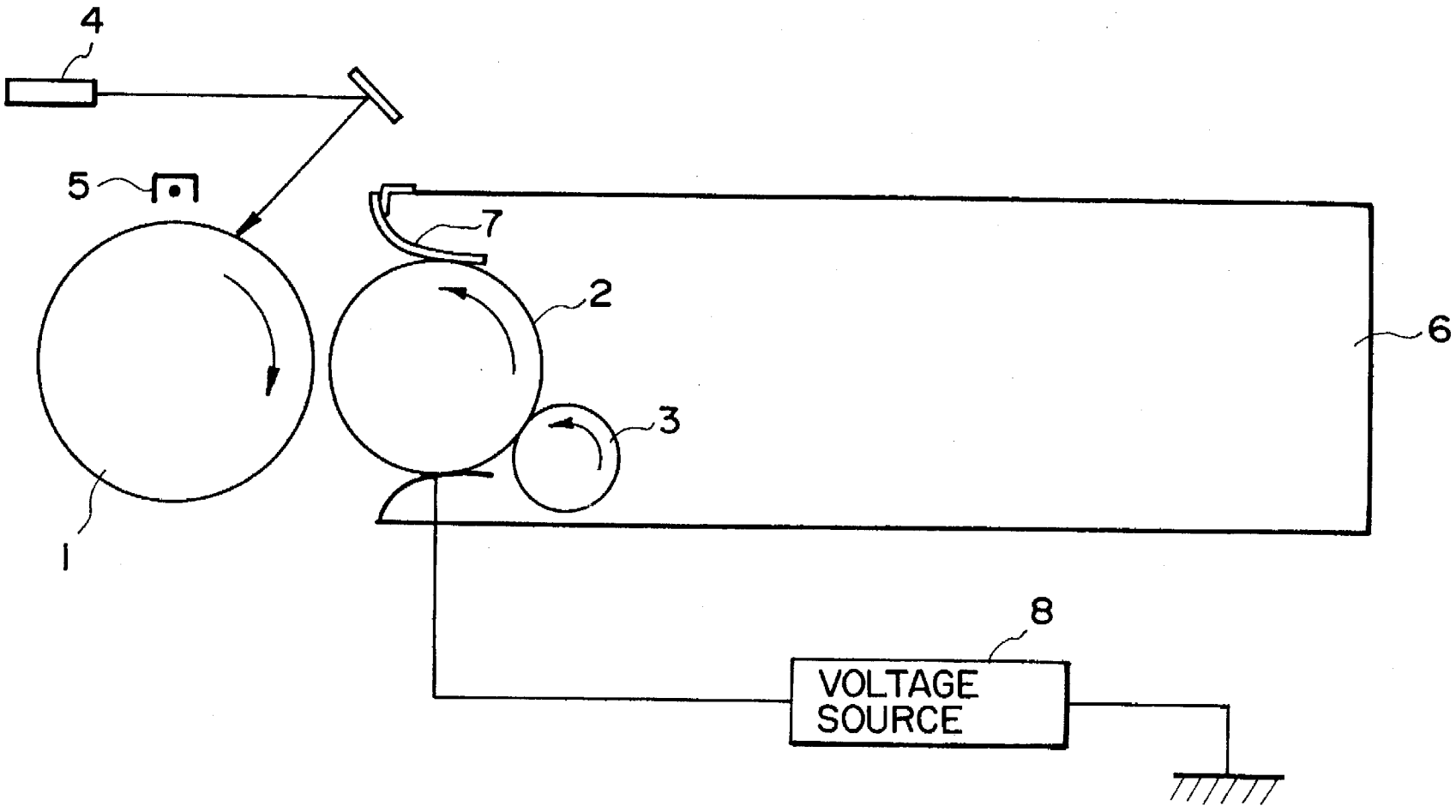
FIG. 9 illustrates a structure of a developing apparatus.
Figure 10:
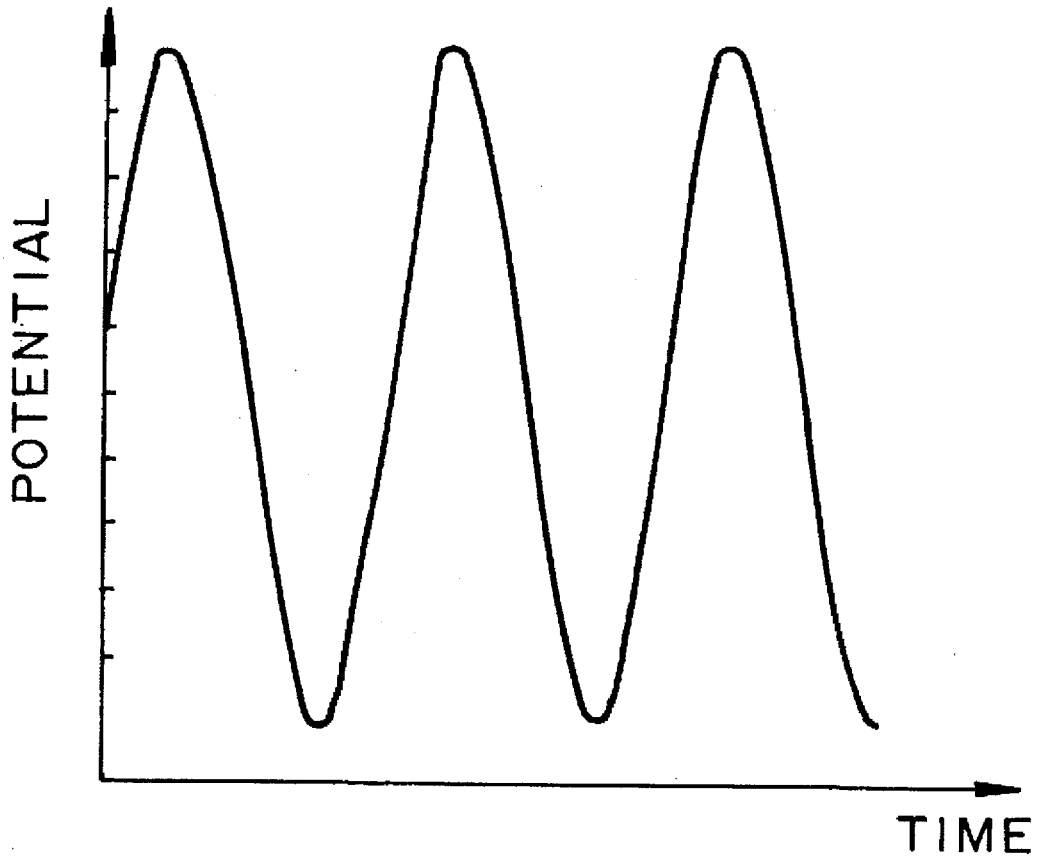
FIG. 10 illustrates a sane waveform of the developing bias voltage.
Figure 11:
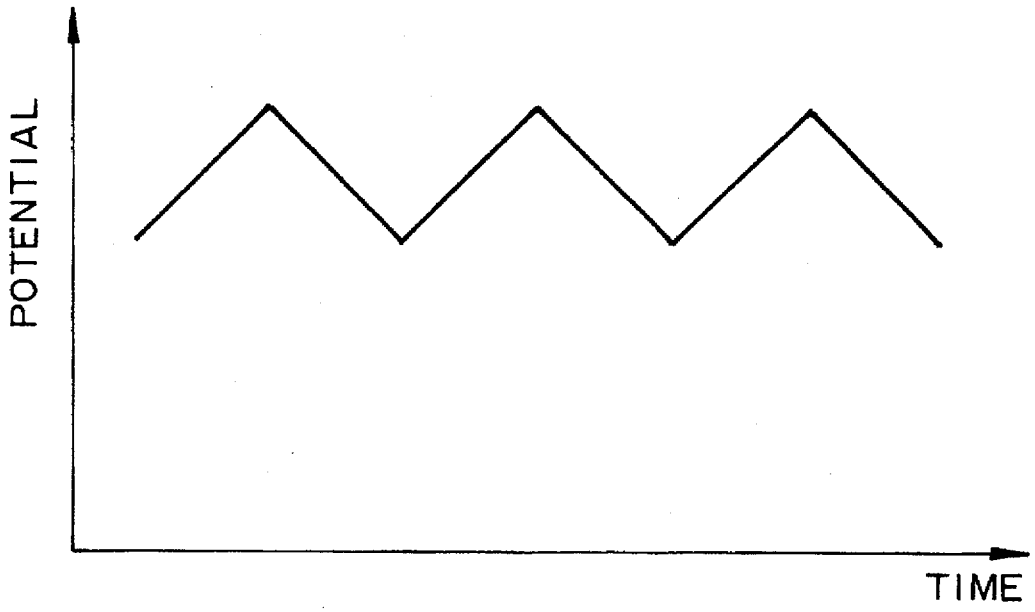
FIG. 11 illustrates a triangular waveform of the developing bias voltage.
Figure 12:
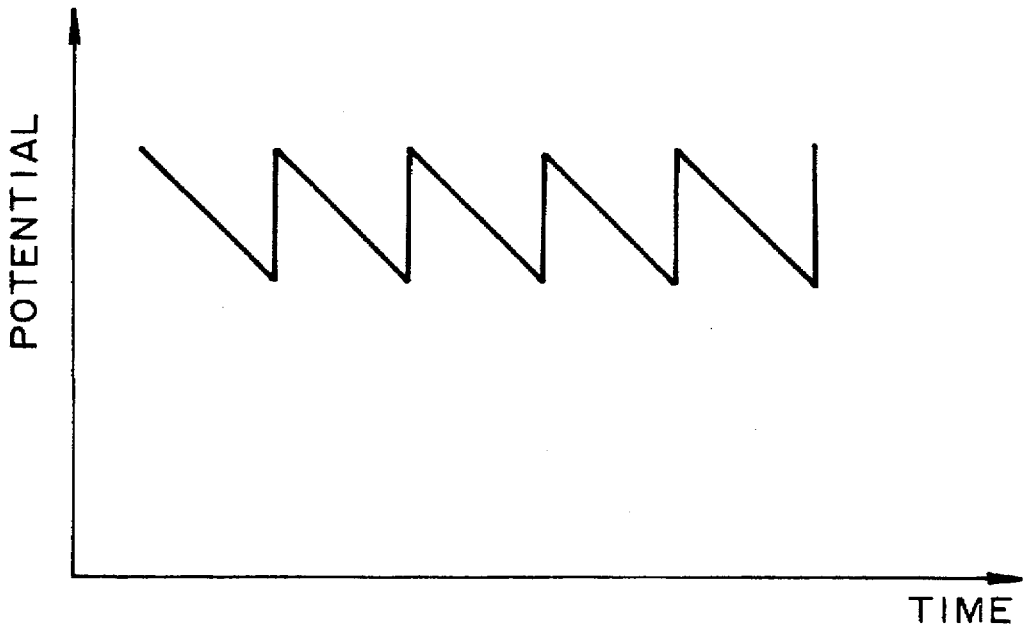
FIG. 12 illustrates a sawtooth developing voltage.
Figure 13:
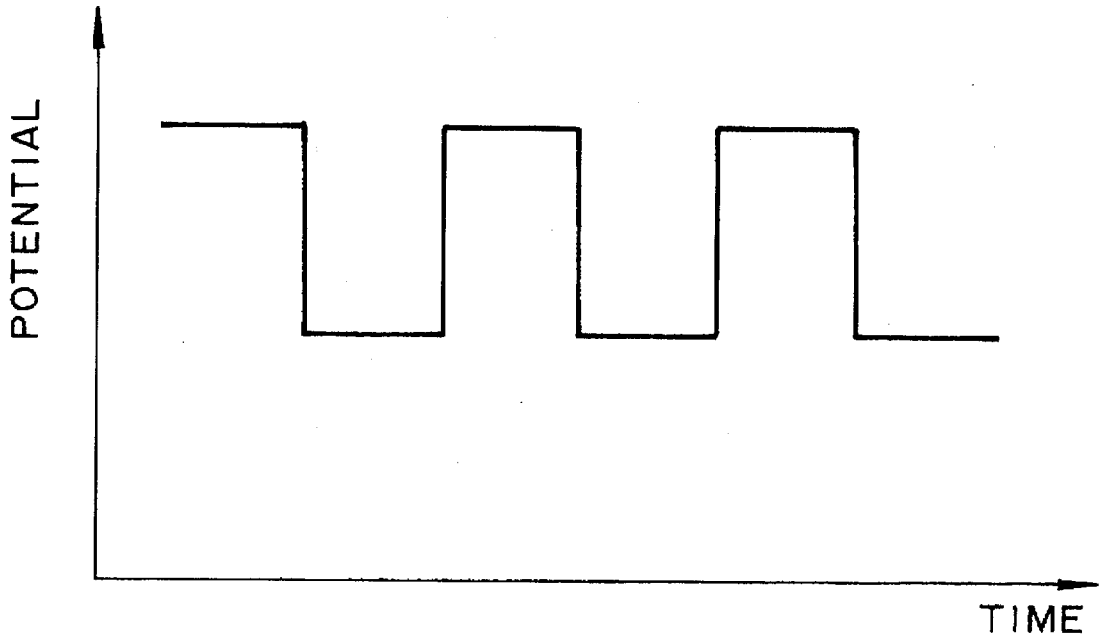
Figure 14:
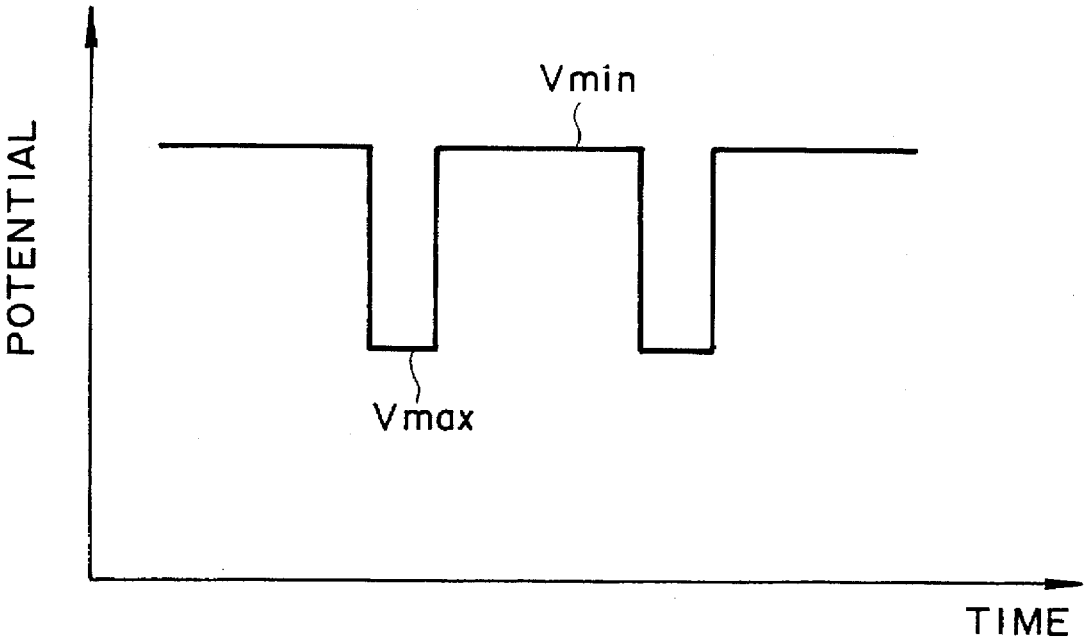

In this embodiment, the developing apparatus has the structure shown in FIG. 9, and use was made of black toner for CLC200 available from Canon Hanbai Kabushiki Kaisha, Japan, and the developing bias was the regulating falling bias voltage as shown in FIG. 1.

More particularly, the regulated falling bias voltage has a frequency of 1000 Hz, a waveform integration average Vdc of −200 V, an amplitude of 1600 V, a duty percentage of 30%, and the inclination percentage of 66.7%. In FIG. 1, there is also shown in a broken line the conventional duty bias voltage for the purpose of clear contrast.

As a result of image formations using the regulated falling bias voltage, good images have been produced without the edge concentration or insufficient image density.

In the foregoing description, a one component non-magnetic toner developer was used. However, the present invention is not limited to such a toner. Magnetic toner is usable, two component developer is also usable with the same advantageous effects. The toner may be positively chargeable as well as negatively chargeable. In this case, the polarity of the developing bias is reversed. The developing method in the foregoing was reverse development, but it may be regular development with the same advantageous effects.

Embodiment 2

Figure 2:
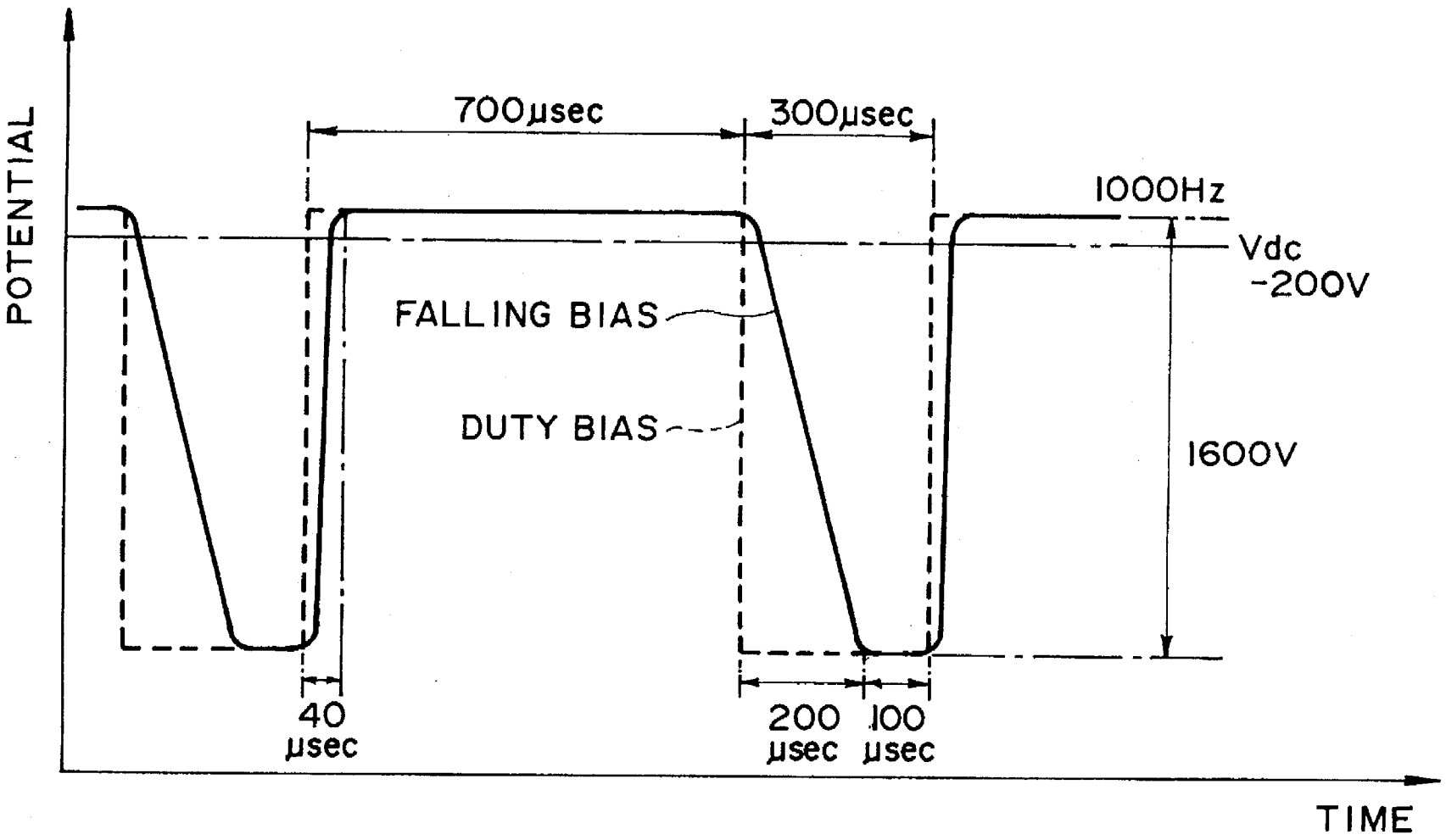
FIG. 2 is a waveform of a developing bias voltage used in a second embodiment of the present invention.

In this embodiment, the developing bias voltage shown in FIG. 2 (regulated falling bias voltage) was used. Embodiment 2 is the same as with the Embodiment 1 in the other respects.

The regulated falling bias voltage had a frequency of 1000 Hz, a waveform integrated average Vdc of −200 V, an amplitude of 1600 V, a duty percentage of 30% and an inclination percentage of 33.3%. Only the inclination percentage is different from the regulated falling bias voltage of Embodiment 1. The developing bias voltage indicated by the broken line in FIG. 2 is the conventional duty bias voltage, as in the first embodiment.

As a result of image formations using the regulated falling bias voltage, good images have been produced without edge concentration or insufficient image density.

Figure 3:
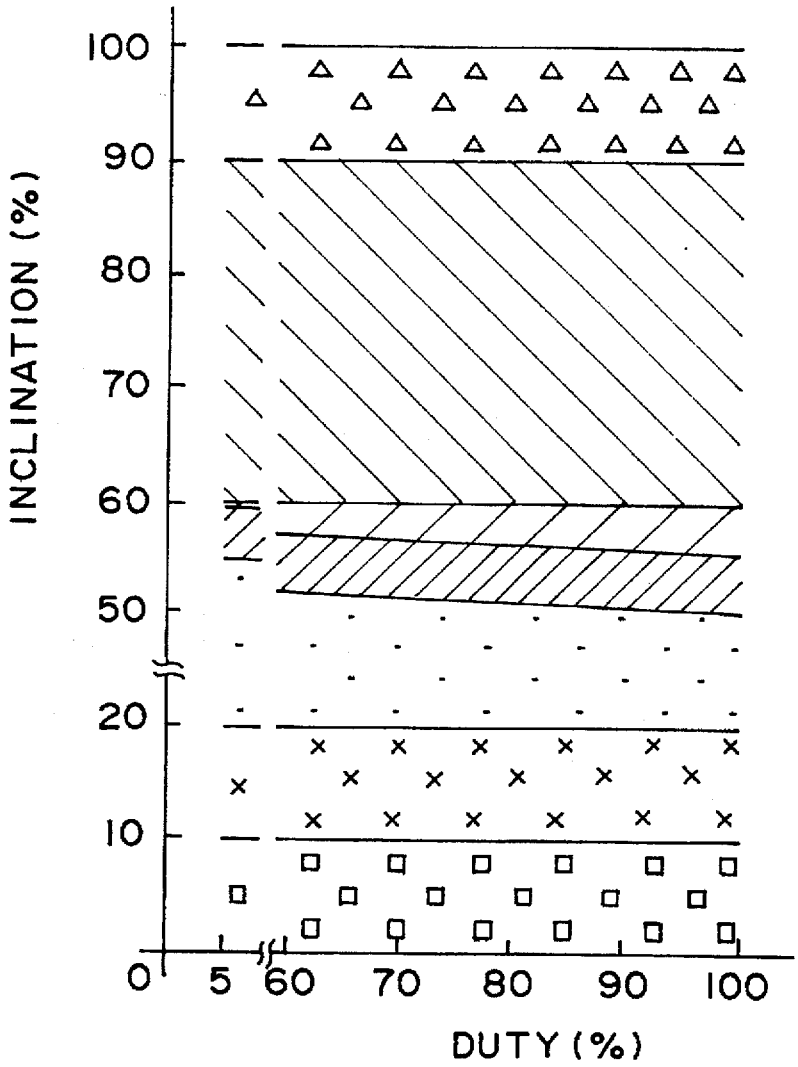
FIG. 3 shows a relationship among a duty percentage, an inclination percentage and a state of the image in the second embodiment.

Referring to FIG. 3, the experiments by the inventors will be described.

FIG. 3 shows a relationship between an inclination percentage and a duty percentage in one period of the alternating component of the developing bias voltage used in development, and production of fog in a 5 mm square image, together with the state of occurrences of edge concentration and insufficient image density.

As will be understood from FIG. 3, in the case that the duty percentage is 95% and 90%, the level of fog is improved if the inclination percentage is 52–56%, and in addition, the level of foggy background is very much improved if it is 0.5–50%.

In the case that the duty percentage is 80% and 70%, the level of the foggy background is improved if the inclination percentage is 53–57%, and in addition, the level of foggy background production is very much improved if inclination percentage is 0.5–51%.

In the case that the duty percentage is 60%, 50% and 40%, the level of the foggy background production is improved if the Inclination percentage is 54–58%, and in addition, the level of foggy background is very much improved if it is 0.5–52%.

In the case that the duty percentage is 30% and 20%, the level of the foggy background is improved if the inclination percentage is 56–59%, and in addition, the level of foggy background is very much improved if it is 0.5–53%.

In the case that the duty percentage is 10% and 5%, the level of foggy background is improved if the inclination percentage is 56–60%, and in addition, the level of the foggy background is very much improved if it is 0.5–54%.

According to the embodiments, the images are free from the edge concentration and insufficient image density, and in addition, fog in the image background can be reduced, if the following is satisfied:

$$10.0 \leqq A \leqq -0.05 \times B + 60.0$$

Preferably, $$20.0 \leqq A \leqq -0.05 \times B + 55.0$$

where A is the inclination percentage=T11/T1×100, and B is a duty percentage=T1/(T1+T2×100.

The duty percentage A and the inclination percentage B of the developing bias voltage used in this embodiment satisfied the above described conditions. Therefore, in this embodiment, edge concentration and density insufficiency is removed, and background fog can be prevented.

Embodiment 3

Figure 4:
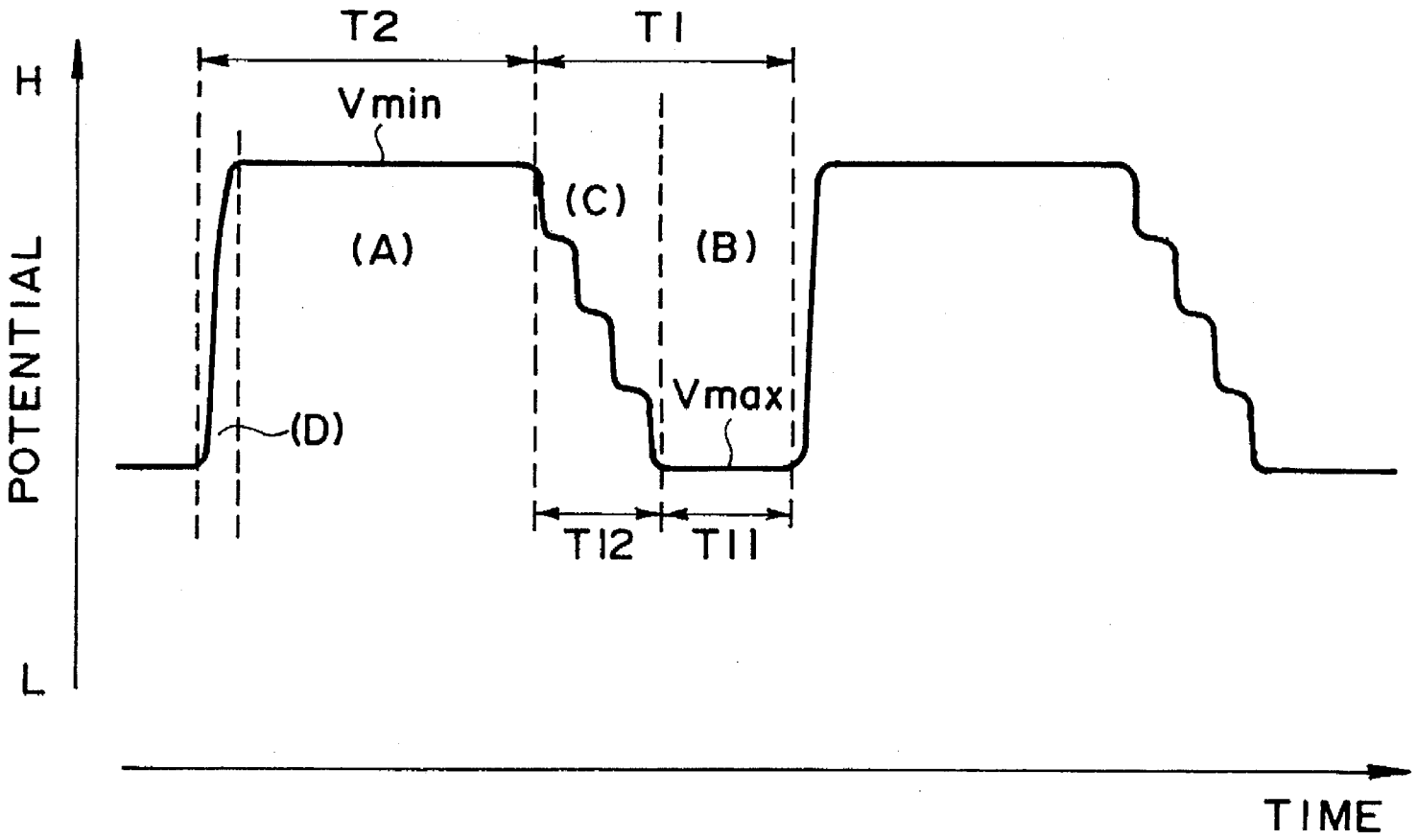
FIG. 4 illustrates a waveform of a developing bias voltage used in a third embodiment of the present invention.

The developing bias voltage used in this embodiment is shown in FIG. 4. It has a stepped waveform in the falling step (C) from the transfer step (A) with the voltage of Vmin and the back-transfer (B) step with the potential of Vmax. The regulated falling bias voltage satisfies the same conditions as in Embodiment 2. This embodiment is the same in other respects.

As a result, the resultant images are free from edge concentration, insufficient image density and foggy background. It will be understood, therefore, that the falling step regulated is not limited to the linear falling fashion to obtain the advantageous effects of the invention.

In this example, the falling waveform is stepwise, but it may be a sine wave, rectangular wave, sawtooth wave, triangular wave, exponential wave or logarithmic wave or the like, with the same advantageous effects. The waveform in the rising step (D) in FIG. 4 may be a sane wave or the like.

As shown in FIG. 4, the waveform in the transfer step (A) and the transfer step (B), is desirably rectilinear, but it may be a sine wave, rectangular wave or the like with the same advantageous effect if the amplitude is reduced to provide a flatter waveform.

Embodiment 4

Figure 5:
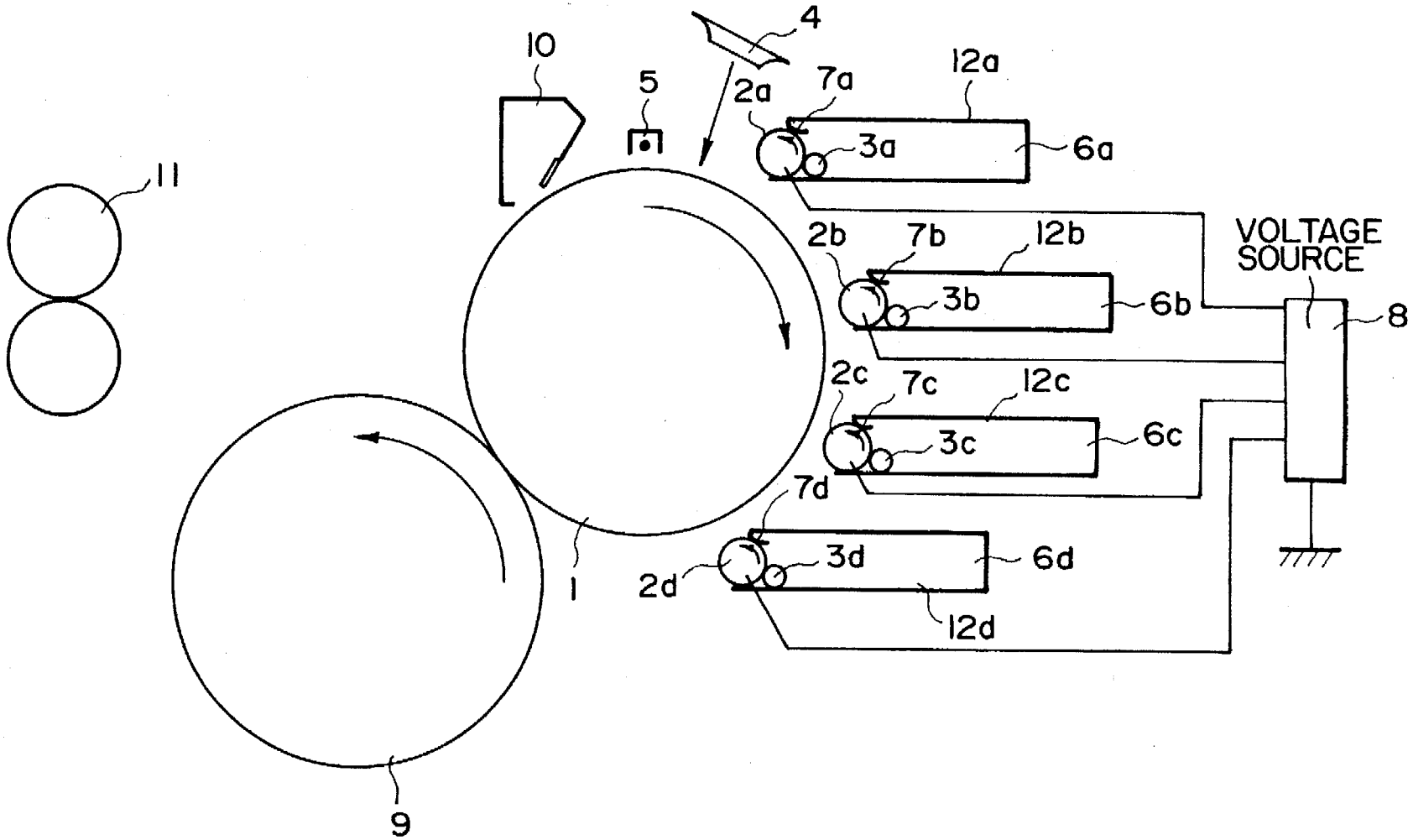
FIGS. 5–8 illustrate color image forming apparatus to which the present invention is usable.

FIG. 5 shows a color image forming apparatus incorporating the developing device of this embodiment.

The image forming apparatus of this embodiment comprises a photosensitive drum 1 having a photosensitive layer applied thereon and made of organic photoconductor, as an image bearing member. The diameter of the photosensitive drum 1 is 80 mm. It is rotated at a speed of 60 mm/sec in the direction indicated by an arrow. Around the photosensitive drum 1, there are provided a primary charger 5, a light emitting element 4 in the form of a laser or LED element or the like, four color developing devices 12*a*, 12*b*, 12*c* and 12*d*, an image transfer drum 9 and a cleaner 10. At a position opposite from the developing devices 12*a*–12*d*, an image fixing device 11 is disposed.

In the developing devices 12*a*, 12*b*, 12*c* and 12*d*, developer containers 6*a*, 6*b*, 6*c* and 6*d*, contain cyan toner, magenta tuner, yellow toner and black toner, respectively. In the developer containers 6*a*, 6*b*, 6*c* and 6*d*, there are disposed developing sleeves 2*a*, 2*b*, 2*c* and 2*d* having a diameter of 16 mm, developer application rollers 3*a*, 3*b*, 3*c* and 3*d* having a diameter of 8 mm for applying toner on the developing sleeve, and elastic blades 7*a*, 7*b*, 7*c* and 7*d* of urethane rubber material for regulating the toner layer formed on the developing sleeve.

In this embodiment, the gap between the developing sleeves 2*a*–2*d* and the photosensitive drum 1 is 300 microns. As for the respective toners in the developing devices 2*a*–2*d*, they are non-magnetic toners (CLC200, available from Canon Hanbai Kabushiki Kaisha, Japan).

A developing bias voltage source 8 is connected to the developing sleeves 2*a*, 2*b*, 2*c* and 2*d* of the developing device. In accordance with the present invention, the regulated falling bias voltage was applied as the developing bias voltage during the developing operation. The regulated falling bias voltage, as shown in FIG. 2 of Embodiment 2, had a frequency of 1000 Hz, a waveform integration average Vdc of −200 V, an amplitude of 1600 V, a duty percentage of 30% and an inclination percentage of 33.3%.

The photosensitive drum 1 is uniformly charged to −600 V by the primary charger 5, and is exposed to image information light for cyan color (first color) by the light emitting element 4. The potential of the exposed portion changes to −100 V, so that an electrostatic latent image for cyan is formed on the photosensitive drum with the exposed portion being the image portion to receive the toner. The electrostatic latent image formed on the photosensitive drum 1 is developed by the cyan developing device 12*a*.

In the developing operation, the regulated falling bias voltage is applied to the developing sleeve 2*a* of the developing device 12 from the voltage source 8, and a developing electric field is produced between the photosensitive drum 1 and the developing sleeve 2*a*, by which the negatively charged cyan toner is transferred from the developing sleeve 2*a* to the surface of the photosensitive drum 1 by the force provided by the electric field. In this manner, the electrostatic latent image is developed into a cyan toner image on the photosensitive drum 1.

On the other hand, the photosensitive drum 9 has been supplied with a transfer sheet (not shown) from a sheet feeding cassette (not shown). The cyan toner image formed on the photosensitive drum is transferred onto the transfer sheet transfer means when the photosensitive drum 1 and the transfer drum 9 are brought to the image transfer position.

The toner remaining on the photosensitive drum 1 after the image transfer operation is removed by a cleaner 10, and thereafter, the photosensitive drum 1 is uniformly charged by the primary charger 5. The second color (magenta) image information light is projected from the light emitting element 4 onto the photosensitive drum 1 to form a magenta electrostatic latent image thereon. The latent image is developed by the magenta developing device 12*b* with the regulated falling voltage applied to the developing sleeve 2*b*, so that a magenta toner image is formed. The thus produced magenta toner image is superposedly transferred onto the cyan toner image on the transfer sheet carried on the transfer drum 9.

The same operations are carried out for the third and fourth colors (yellow and black). The photosensitive drum is cleaned by a cleaner 10, and the primary charge of the transfer drum 1 by the primary charger 5, yellow and black latent image formation by the exposure using the light emitting element 4, development of the latent image under the application of the regulated bias voltage using the yellow and black developing devices 12*c* and 12*d*, and the image transfer of the yellow and black toner images onto the transfer sheet, are carried out. By doing so, four color toner images (cyan, magenta, yellow and black) are superposedly transferred onto the transfer sheet into one color image.

Thereafter, the transfer sheet now having the four color toner images, is electrically discharged by an unshown discharger, and is separated from a transfer drum 9. Then, it is introduced into an image fixing device 11, where the four toner images are mixed in color and fixed on the transfer sheet into a permanent full-color image. Subsequently, it is discharged to the outside of the image forming apparatus.

In such a color image forming apparatus, a plurality of colors of the toner images are overlaid, and therefore, the image quality is more deteriorated than in the monochromatic image if the respective toner images involve edge concentration, insufficient image density or foggy background. However, according to the present invention, the falling bias voltage is regulated in the inclination percentage, and therefore, the edge concentration, the density insufficiency or the foggy background of the toner image of each other can be removed, and therefore, the high quality of the image can be provided even in the color image, without difficulty.

In the foregoing description, the developer used was a one component non-magnetic toner to form a color image. However, the present invention is not limited to such a toner, as in Embodiment 1. Magnetic toner is usable, two component developer is also usable with the same advantageous effects. The toner may be positively chargeable as well as negatively chargeable. In this case, the polarity of the developing bias is reversed. The developing method in the foregoing may be reveres development or a regular development with the same advantageous effects.

Figure 6:
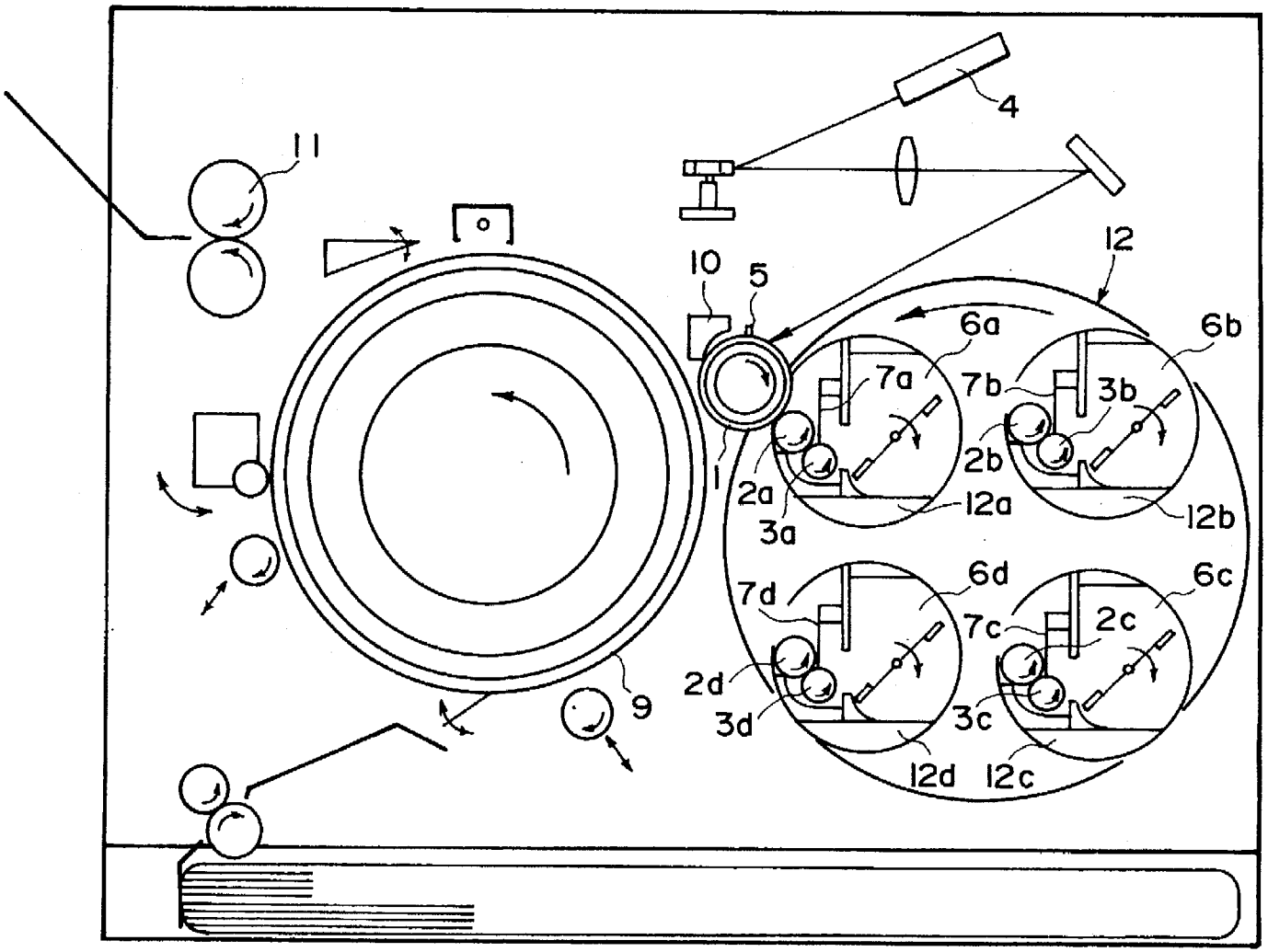

The image forming apparatus has been shown as being fixedly disposed around the photosensitive drum 1 the developing devices 12*a*–12*d*. However, as shown in FIG. 6, the developing devices 12*a*–12*d* may be of cartridge types and are formed into a rotary type developing device 12, in which the rotary type developing device 12 is rotated by a unit or cartridge selection mechanism to prevent proper one of the developing devices 12*a*–12*d* to the photosensitive drum 1. In FIG. 6, the same reference numerals as in FIG. 5 are assigned to the element having the corresponding functions.

Figure 7:
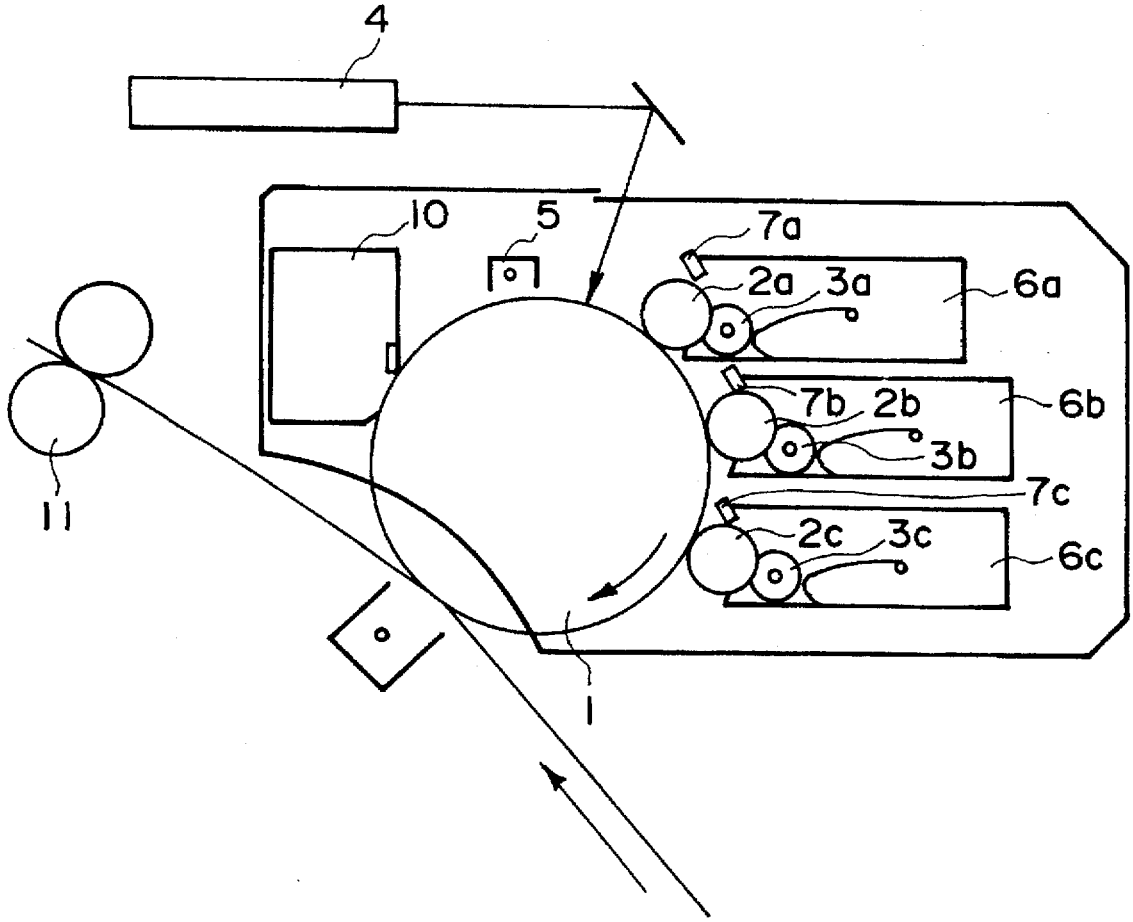
Figure 8:
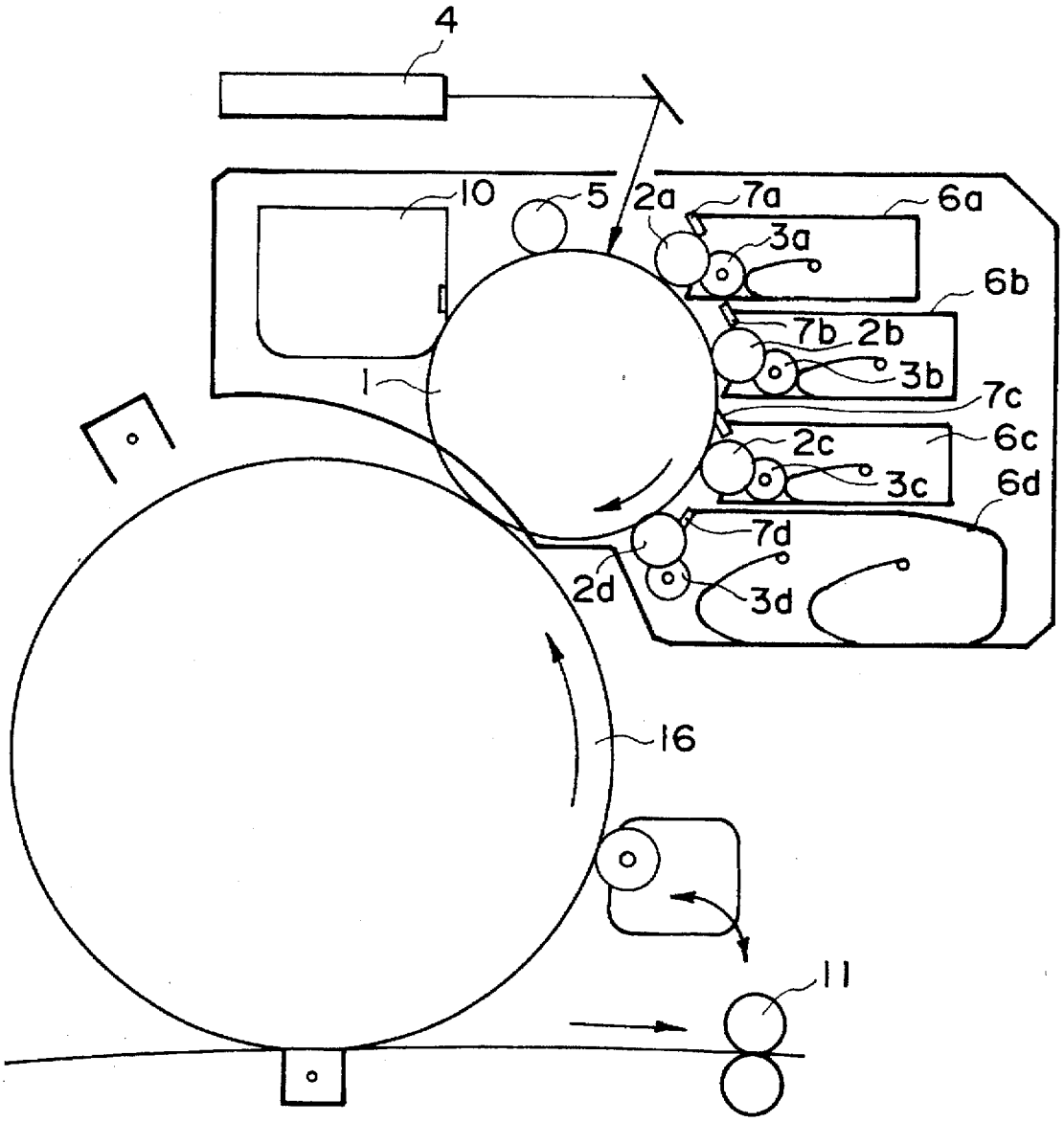

In this embodiment, the color images are formed by overlaying the toner images on the transfer material. As shown in FIG. 7, the toner images may be developed on the photosensitive drum. As shown in FIG. 8, the toner images may be transferred onto an intermediate transfer member 16.

As described in the foregoing, according to Embodiments 1–4, a DC biased AC voltage is applied to the developer carrying member in the developing operation, and the falling voltage is regulated such that the inclination percentage in the falling step in one period of the alternating component of the bias voltage is within a predetermined range, and therefore, the image without the edge concentration, insufficient density can be obtained without difficulty.

Embodiment 5

In this embodiment, the charge amount of the developer is obtained, and a further high quality image can be provided. In this embodiment, the inclination percentage and the duty percentage in the AC component, of the falling bias voltage is regulated in connection with a charge amount q/m per unit weight of the toner carried on the developing sleeve, by which toner scattering and discharging is prevented during the developing operation, and the resultant images are free from edge concentration and insufficient density, without difficulty.

Generally speaking, it is known that there is a close relationship between a quality of a toner image and a charge amount q/m (μC/g) per unit weight of the toner constituting the toner image, and that the range |q/m| is 6.0–35.0 μC/g to provide a high quality image.

It is possible to obtain a sufficient image density even if the developing operation is effected using a developing bias voltage in the form of a sine wave, a triangular wave or sawtooth wave, if |q/m| is reduced. However, the toner particles tend to scatter with the result of contamination of the inside of the image forming apparatus. If |q/m| is increased, sufficient image density is not provided even if a duty bias and rectangular wave are used.

As a method for increasing the image density with |q/m| maintained, there are known a method in which an amplitude of the alternating component of the developing bias voltage applied across the SD gap in the developing zone, a method in which the DC component is increased, a method in which the peripheral speed of the developing sleeve is increased, or the like.

However, the increase of the amplitude of the AC component of the developing bias voltage or the increase of the DC voltage, as described hereinbefore, would result in spark discharge or the like between the developing sleeve and the photosensitive drum (SD gap). In addition, there is a liability of occurrence of fog. When the peripheral speed of the developing sleeve is increased, the air flow enhanced by the increased peripheral speed would result in toner scattering. Therefore, these methods are not practical.

If the charge amount of the toner is reduced so as to prevent discharging or the like, and |q/m→ is selected to be 2.0–5.0 μC/g, toner scattering and foggy background or the like are increased to impractical extent.

Accordingly, in this embodiment, as will be described in detail hereinafter, the regulated falling voltage is changed in accordance with the charge amount q/m of the toner, so that good images without edge concentration and insufficient image density and without toner scattering or discharging, is achieved without difficulty. The experiments have been carried out for this purpose to determine the regulation of the falling part of the bias voltage in accordance with the charge amount q/m of the toner.

In the experiments, the developing device as shown in FIG. 9 is used in experiment apparatus shown in FIG. 17, and a 5 mm square image is formed through development. Then, edge concentration and insufficient image density have been investigated. The toner used was black toner for CLC200 available from Canon Hanbai Kabushiki Kaisha. The toner amount (application amount) of the toner layer applied on the developing sleeve 2 (m/s) was 0.4 mg/cm$^2$.

FIG. 31 shows a relationship between the inclination percentage and the duty percentage in one period of the alternating component of the developing bias voltage used in the experiments, and the state of occurrence of edge concentration in the obtained 5 mm square image.

The charge amount of toner q/m was changed in a range of −6.0 μC/g—35.0 μC/g, and the duty percentage was changed in the range of 5.0%–95.01%. For the respective duty percentages, the inclination percentage was changed in the range of 0.5%–99.5%.

As will be understood from FIG. 31, in the case that the toner charge amount q/m is −18 μC/g—35 μC/g, the edge concentration of the image is reduced to the level of no practical problem for all duty percentages ranging from 5.0–95.0% if the inclination percentage is 60.0–90.0%. If the inclination percentage is 0.5–60%, the edge concentration is completely removed.

In the case that q/m is −14.0 μC/g, (1) if the duty percentage is 95.0% and 90.0% with the inclination percentage of 55.5–85.5%, the edge concentration is reduced to the level of no practical problems. If the inclination percentage is 0.5–55.0%, the edge concentration is completely removed, (2) If the duty percentage is 80.0% and 70.0%, with the inclination percentage of 56.0–86.0%, the edge concentration is reduced to the level of no practical problem. If the inclination percentage is 0.5–56.0%, the edge concentration is completely removed. (3) If the duty percentage is 60.0%, 50.0% and 40.0% with the inclination percentage of 57.5–87.5%, the edge concentration is reduced to the level of no practical problem. If the inclination percentage is 0.5–57.5%, the edge concentration Is completely removed. (4) If the duty percentage is 30.0% and 20.0% with the inclination percentage of 59.0–89.0%, the edge concentration is reduced to the level of no practical problem. If the inclination percentage is 0.5–59.0%, the edge concentration is completely removed. (5) If the duty percentage is 10.0 and 5.0%, with the inclination percentage of 59.7–89.7%, the edge concentration is reduced to the level of no practical problem. If the inclination percentage is 0.5–59.7%, the edge concentration is completely removed.

In the case that q/m is −10.0 μC/g, (1) if the duty percentage is 95% and 90.0% with the inclination percentage of 51.0–80.1%, the edge concentration is reduced to the level of no practical problem. If the inclination percentage is 0.5–55.5%, the edge concentration is completely removed. (2) If the duty percentage is 80.0 and 70.0% with the inclination percentage of 52.5–82.5%, the edge concentration is reduced to the level of no practical problem. If the inclination percentage is 0.5–52.5%, the edge concentration is completely removed. (3) If the duty percentage is 60.0%, 50.0% and 40.0% with the inclination percentage of 55.0–85.0%, the edge concentration is reduced to the level of no practical problem. If the inclination percentage is 0.5–55.0%, the edge concentration is completely removed. (4) If the duty percentage is 30.0% and 20.0% with the inclination percentage of 57.5–87.5%, the edge concentration is reduced to the level of no practical problem. If the inclination percentage is 0.5–57.5%, the edge concentration is completely removed. (5) If the duty percentage is 10.0% and 5.0% with the inclination percentage of 59.5–89.5%, the edge concentration is reduced to the level of no practical problem. If the inclination percentage is 0.5–59.5%, the edge concentration is completely removed.

In the case that q/m is −6.0 μC/g, (1) if the duty percentage is 95% and 90.0% with the inclination percentage of 46.5–76.5%, the edge concentration is reduced to the level of no practical problem. If the inclination percentage is 0.5–46.5%, the edge concentration is completely removed. (2) If the duty percentage is 80.0% and 70.0% with the inclination percentage of 49.0–79.0%, the edge concentration is reduced to the level of no practical problem. If the inclination percentage is 0.5–49.0%, the edge concentration is completely removed. (3) If the duty percentage is 60.0%, 50.0% and 40.0% with the inclination percentage of 52.5–82.5%, the edge concentration is reduced to the level of no practical problem. If the inclination percentage is 0.5–52.5%, the edge concentration is completely removed. (4) If the duty percentage is 30.0% and 20.0% with the inclination percentage of 56.5–86.5%, the edge concentration is reduced to the level of no practical problem. If the inclination percentage is 0.5–56.5%, the edge concentration is completely removed. (5) If the duty percentage is 10.0% and 5.0% with the inclination percentage of 59.0–89.0%, the edge concentration is reduced to the level of no practical problem. If the inclination percentage is 0.5–59.0%, the edge concentration is completely removed.

The foregoing is the results of experiments.

FIG. 32 shows a relationship between the inclination percentage and the duty percentage in one period of the alternating component of the developing bias voltage used in the experiments, and the state of occurrence of insufficient image density in the obtained 5 mm square image.

Similarly, the charge amount of toner q/m was changed in a range of −6.0 μC/g—26.0 μC/g, and the duty percentage was changed in the range of 5.0%–95.0%. For the respective duty percentages, the inclination percentage was changed in the range of 0.5%–99.5%.

As will be understood from FIG. 32, in the case that the toner charge amount q/m is −6 μC/g—26 μC/g, insufficient density of the image is reduced to the level of no practical problem for all duty percentages ranging from 5.0–95.0% if the inclination percentage is 10.0–20.0%. If the inclination percentage is 2.0–99.5%, the image density is sufficient.

In the case that q/m is −29.0 μC/g, (1) if the duty percentage is 95.0% and 90.0% with the inclination percentage of 10.3–20.3%, insufficient density is reduced to the level of no practical problem. If the inclination percentage is not less than 20.3%, image density is sufficient. (2) If the duty percentage is 80.0% and 70.0%, with an inclination percentage of 10.8–20.8%, insufficient density is reduced to the level of no practical problem. If the inclination percentage is not less than 20.8%, image density is sufficient, (3) If the duty percentage is 60.0%, 50.0% and 40.0% with the inclination percentage of 11.5–21.5%, insufficient density is reduced to the level of no practical problem. If the inclination percentage is not less than 21.5%, the image density is sufficient. (4) If the duty percentage is 30.0% and 20.0% with the inclination percentage of 12.3–22.3%, insufficient density is reduced to the level of no practical problem. If the inclination percentage is not less than 22.3%, the image density is sufficient. (5) If the duty percentage is 10.0 and 5.0% with the inclination percentage of 12.6–22.6%, insufficient density is reduced to the level of no practical problem. If the inclination percentage is not less than 22.6%, the density is sufficient.

In the case that q/m is −32.0 μC/g, (1) if the duty percentage is 95% and 90.0% with the inclination percentage of 10.7–20.7%, insufficient density is reduced to the level of no practical problem. If the inclination percentage is not less than 20.7%, the image density is sufficient. (2) If the duty percentage is 80.0 and 70.0% with the inclination percentage of 11.5–21.5%, insufficient density is reduced to the level of no practical problem. If the inclination percentage is not less than 21.5%, the image density is sufficient. (3) If the duty percentage is 60.0%, 50.0% and 40.0% with the inclination percentage of 12.8–22.8%, insufficient density is reduced to the level of no practical problem. If the inclination percentage is not less than 22.8%, the density is sufficient. (4) If the duty percentage is 30.0% and 20.0% with the inclination percentage of 14.3–24.3%, insufficient density is reduced to the level of no practical problem. If the inclination percentage is not less than 24.3%, the image density is sufficient. (5) If the duty percentage is 10.0% and 5.0% with the inclination percentage of 15.3–25.3%, insufficient density is reduced to the level of no practical problem. If the inclination percentage is not less than 25.3%, the density is sufficient.

In the case that q/m is −35.0 μC/g, (1) if the duty percentage is 95% and 90.0% with the inclination percentage of 11.0–21.0%, insufficient density is reduced to a level of no practical problem. If the inclination percentage is not less than 21.0%, the image density is sufficient. (2) If the duty percentage is 80.0% and 70.0% with the inclination percentage of 12.0–22.0%, insufficient density is reduced to a level of no practical problem. If the inclination percentage is not less than 22%, the image density is sufficient. (3) If the duty percentage is 60.0%, 50.0% and 40.0% with the inclination percentage of 14.0–24.0%, insufficient density is reduced to a level of no practical problem. If the inclination percentage is not less than 24%, sufficient density is provided. (4) If the duty percentage is 30.0% and 20.0% with the inclination percentage of 16.5–26.5%, insufficient density is reduced to a level of no practical problem. If the inclination percentage is not less than 26.5%, the image density is sufficient. (5) If the duty percentage is 10.0% and 5.0% with the inclination percentage of 17.0–27.0%, insufficient density is reduced to a level of no practical problem. If the inclination percentage is not less than 27%, the image density is sufficient.

The foregoing is the results of experiments.

As will be understood from FIGS. 31 and 32, the inclination percentage (%)=A=T11/T1×100 and the duty percentage (%)=B=T1/(T1+T2)×100 are set in accordance with the toner charge amount q/m, as follows:

When −18.0 μC/g≦q/m≦−6.0 μC/g $10.0 \leqq A \leqq -(-1.25 \times |q/m| + 22.5) \times B/100 + 90.0$ When −26.0 μC/g≦q/m≦−18.0 μC/g $10.0 \leqq A \leqq 90.0$ When −35.0 μC/g≦q/m≦−26.0 μC/g $(-0.89 \times |q/m| + 18.7) \times (B/100 - 1.0) + 10.0 \leqq A \leqq 90.0$ By satisfying the above conditions, images without edge concentration or insufficient image density can be provided without toner scattering and discharging.

Further preferably, the following conditions are satisfied:

When −18.0 μC/g≦q/m≦−6.0 μC/g $20.0 \leqq A \leqq -(-1.25 \times |q/m| + 22.5) \times B/100 + 60.0$ When −26.0 μC/g≦q/m≦−18.0 μC/g $20.0 \leqq A \leqq 60.0$ When −35.0μC/g≦q/m≦−26.0 μC/g $(-0.89 \times |q/m| + 18.7) \times (B/100 - 1.0) + 20.0 \leqq A \leqq 60.0$ Although the reason for this is not clear, according to the regulated falling bias voltage, the reciprocating motion, in the SD gap, of the toner particles having different charge amounts is controlled by the falling period of the AC component of the developing bias voltage, so that the toner reciprocation in the wide end portion of the SD gap can be prevented for all of the toner particles irrespective of the charge amount of the toner, and therefore, the toner can be sufficiently reciprocated in the narrow central portion of the SD gap. Accordingly, edge concentration and insufficient density can be prevented in the developed image.

FIG. 33 shows a relationship between the movement period of the toner from the developing sleeve to the photosensitive drum in the SD gap and the toner charge amount, when the regulated falling bias voltage applied to the developing sleeve is different.

Referring to FIG. 33, in the case that the charge amount of the toner q/m is small, the toner ta having a small charge amount starts to move from the developing sleeve to the photosensitive drum when the potential of the developing sleeve becomes Va. If the charge amount of the toner q/m is large, then toner tb having a large charge amount starts to move from the developing sleeve to the photosensitive drum when the potential of the developing sleeve become Vb. When a developing bias voltage B1 having a large inclination percentage is used as indicated by a solid line in the FIG. 33, the moving periods of the toner ta having a small charge amount and the toner tb having a large charge amount, are Ta1 and Tb1. When the developing bias voltage B1 is used, the toner tb having a large charge amount does not result in edge concentration, but the toner ta having a small charge amount has a longer moving period Ta1. Therefore, as described in the foregoing, the toner makes a motion that deviates toward the outside at the end portion in the SD gap with the result of toner stagnation M being produced, and therefore, edge concentration occurs. For this reason, for the toner ta having a small charge amount, the developing bias voltage B2 having a small inclination percentage indicated by the broken in FIG. 33 is desirably used. By doing so, the toner moving period for the toner ta is shortened from Ta1 to Ta2. Then, the production of edge concentration of the image can be prevented.

When the rising period of the developing bias voltage is long, as shown by broken line in FIG. 38, the moving period of the toner ta having a small charge amount becomes longer with the result of toner reciprocation occurring at the end of the SD gap so that edge concentration occurs. For this reason, a shorter rising period is preferable.

FIG. 34 shows a relationship between a moving period of the toner from the developing sleeve toward the photosensitive drum in the central portion of the SD gap when the regulated falling bias voltage applied to the developing sleeve is different.

Referring to FIG. 34, when the charge amount of a toner q/m is small, toner ta having the small charge amount starts to move from the developing sleeve to the photosensitive drum when the potential of the developing sleeve becomes Va. When the charge amount of the toner q/m is large, toner tb having a large charge amount starts to move from the developing sleeve to the photosensitive drum when the potential of the developing sleeve becomes Vb. When a developing bias voltage B4 having a small inclination percentage is used, as indicated by a solid line in FIG. 34, the moving periods of the toner ta having a small charge amount and the toner tb having a large charge amount, are Ta4 and Tb4. With the developing bias voltage B4, the toner tb having a small charge amount does not result in insufficient image density, but the toner tb having a large charge amount has a shorter moving period Tb4, and therefore, insufficient image density occurs. For this reason, for the toner tb having a large charge amount, the developing bias voltage B3 having a large inclination percentage indicated by a broken line in FIG. 34 is desirably used. By doing so, the toner moving period for the toner tb can be made longer from Tb4 to Tb3, and therefore, insufficient image density of the image can be prevented from occurring.

As described in the foregoing, in order to increase the image density, there are (1) a method in which the amplitude of the AC component of the developing bias voltage is increased, or the DC component is changed, and (2) a method in which the charge amount of the toner q/m is lowered. The method (1) would result in discharge, and method (2) would result in toner scattering. In this embodiment, however, as described in the foregoing, the falling step (C) period of the regulated falling bias voltage and the transfer step period (voltage Vmax) (B), are controlled, so that the density is increased. Therefore, density increase may be accomplished without discharge and toner scattering.

Embodiment 6

In this embodiment, a regulated falling bias voltage having a stepwise waveform is used for the falling part of the bias voltage, shown in FIG. 4 (Embodiment 3). The regulated bias voltage satisfies the conditions in Embodiment 5. The charge amount q/m of the black toner (CLC200) was −20.0 μC/g. The application amount of the toner layer on the developing sleeve m/s was 0.4 mg/cm$^2$. This embodiment is the same as the Embodiment 5 in other respects.

As a result, images without edge concentration and insufficient image density could be provided without spark discharge and toner scattering or the like. As will be understood, the regulated falling bias voltage is not limited to a rectilinear voltage, and the effects of the present invention are still provided.

In this embodiment, the waveform of the falling voltage of the regulating falling part is in the form of a step, but it may be a sine wave, rectangular wave, sawtooth wave, triangular wave, exponential wave or logarithmic wave or the like, with the same advantageous effect. The waveform in the rising step may be a sine wave or the like.

As shown in FIG. 4, the waveform in the transfer step (B) with the potential of Vmax and the waveform in the back-transfer step (A) with the potential of Vmin are preferably rectilinear. However, if the waveform is flattened by reducing the amplitude, a sine wave or rectangular wave or the like can be used with the same advantageous effects.

Embodiment 7

In this embodiment, the color image forming apparatus shown in FIG. 5 (Embodiment 4) is used, and the developing devices 12*a*–12*d* are incorporated the present invention.

In this embodiment, similarly to Embodiment 6, a toner layer having an application amount m/s of 0.4 mg/cm$^2$ is formed using an elastic blade 7*a*–7*d* on the developing sleeves 2*a*–2*d* of the developing devices 12*a*–12*d* in FIG. 5. The toner is electrically charged to the charge amount q/m of −20.0 μC/g.

The regulated falling bias voltage part of the developing bias had a frequency of 1000 Hz, Vdc of −200 V, an amplitude of 1600 V, a duty percentage of 30%, an inclination percentage of 66.7%, so as to satisfy the conditions described in conjunction with Embodiment 5.

The other conditions of this embodiment were the same as in Embodiment 4. As a result, a color image without edge concentration or insufficient image density could be provided without toner scattering and discharge.

As in Embodiment 4, the developing device of the image forming apparatus may be a rotary type developing device 12 using developing unit cartridges 12*a*–12*d*, as shown in FIG. 6, wherein the rotary type developing device 12 is rotated by a cartridge selection mechanism, so that the developing devices 12*a*–12*d* are moved to a developing position faced to the photosensitive drum 1.

The color image was formed through a method in which toner images having different colors are superposed on the toner image onto the transfer material. However, as shown in FIG. 7, the toner images of the different colors may be formed on the photosensitive drum 1. Alternatively, as shown in FIG. 8, the toner images of different colors may be transferred onto an intermediate transfer member 16.

In any case, a color image without edge concentration or density insufficiency can be formed without toner scattering and discharging.

As described in the foregoing, according to Embodiments 5–7, the developing bias used is in the form of superposed DC and AC voltages to be applied to the developer carrying member in the developing operation, and the falling part of the developing bias voltage is regulated. In addition, the inclination percentage and the duty percentage in the falling step in one period or cycle of the AC component of the bias voltage, is on the basis of the toner charge amount q/m. This is effective to provide good images without edge concentration or density insufficiency, without toner scattering and discharging.

Embodiment 8

In this embodiment, the amount of the developer is obtained to provide a higher quality image. In this embodiment, the amount of toner in the toner layer applied and formed into a thin layer on the developing sleeve, that is, the toner application amount m/s is used in determining the inclination percentage and the duty percentage in the AC component of the falling regulated bias voltage. By doing so, good images without edge concentration and insufficient image density can be provided easily without the occurrence of toner scattering and discharging.

Generally speaking, it is known that there is a close relationship between a quality of a toner image and a toner application amount m/s (mg/cm$^2$) per unit area on the sleeve, and that the range of m/s is 0.2–1.5 μC/g to provide a high quality image.

It is possible to obtain a sufficient image density even if the developing operation is effected using a developing bias voltage in the form of a sine wave, a triangular wave or sawtooth wave, if m/s is increased. However, the toner particles tend to scatter with the result of contamination of the inside of the image forming apparatus. If m/s is decreased, sufficient image density is not provided even if the duty bias and the rectangular wave is used.

As a method for increasing the image density with m/s maintained, there are known a method in which an amplitude of the alternating component of the developing bias voltage is applied across the SD gap in the developing zone, a method in which the DC component is increased, a method in which the peripheral speed of the developing sleeve is increased, or the like.

However, an increase of the amplitude of the AC component of the developing bias voltage or an increase of the DC voltage, as described hereinbefore, would result in spark discharge or the like between the developing sleeve and the photosensitive drum (SD gap). In addition, there is a liability of occurrence of fog. When the peripheral speed of the developing sleeve is increased, the air flow enhanced by the increased peripheral speed would result in toner scattering. Therefore, these methods are not practical.

If the charge amount of the toner is reduced so as to prevent discharging or the like, and m/s is selected to be 2.0–3.0 mg/cm$^2$, then toner scattering and foggy background or the like are increased an impractical extent.

Accordingly, in this embodiment, as will be described in detail hereinafter, the regulated falling voltage is changed in accordance with the application amount m/s of the toner, so that good images without edge concentration and insufficient image density are produced without toner scattering or discharging, without difficulty. The experiments have been carried out for this purpose to determine the regulation of the falling part of the bias voltage in accordance with the application amount m/s of the toner.

In the experiments, the developing device as shown in FIG. 9 is used in the experiment apparatus shown in FIG. 17, and a 5 mm square image is formed through development. Then, edge concentration and insufficient image density have been investigated. The toner used was black toner for CLC200 available from Canon Hanbai Kabushiki Kaisha. The toner amount (application amount) of the toner layer applied on the developing sleeve 2 (m/s) was 0.4 mg/cm$^2$.

FIG. 35 shows a relationship between the inclination percentage and the duty percentage in one period of the alternating component of the developing bias voltage used in the experiments, and the state of occurrence of edge concentration in the obtained 5 mm square image.

The application or coating amount of toner m/s was changed in a range of 0.2 mg/cm$^2$–11.5 mg/cm$^2$, and the duty percentage was changed in the range of 5.0%–95.0%. For the respective duty percentages, the inclination percentage was changed in the range of 0.5%–99.5%.

As will be understood from FIG. 35, in the case that the toner coating amount m/s is not more than 0.6 mg/cm$^2$, edge concentration of the image is reduced to a level of no practical problem for all duty percentages ranging from 5.0–95.0% if the inclination percentage is 60.0–90.0%. If the inclination percentage is 0.5–60%, the edge concentration is completely removed.

In the case that m/s is 0.9 mg/cm$^2$, (1) if the duty percentage is 95.0% and 90.0% with the inclination percentage of 55.5–85.5%, edge concentration is reduced to a level of no practical problem. If the inclination percentage is 0.5–55.0%, the edge concentration is completely removed. (2) If the duty percentage is 80.0% and 70.0%, with the inclination percentage of 56.0–86.0%, edge concentration is reduced to a level of no practical problem. If the inclination percentage is 0.5–56.0%, the edge concentration is completely removed. (3) If the duty percentage is 60.0%, 50.0 % and 40.0% with the inclination percentage of 57.5–87.5%, edge concentration is reduced to a level of no practical problem. If the inclination percentage is 0.5–57.5%, the edge concentration is completely removed. (4) If the duty percentage is 30.0% and 20.0% with the inclination percentage of 59.0–89.0%, edge concentration is reduced to a level of no practical problem. If the inclination percentage is 0.5–59.0%, the edge concentration is completely removed. (5) If the duty percentage is 10.0 and 5.0%, with the inclination percentage of 59.7–89.7%, edge concentration is reduced to a level of no practical problem. If the inclination percentage is 0.5–59.7%, the edge concentration is completely removed.

In the case that m/s is 1.2 mg/cm$^2$, (1) if the duty percentage is 95% and 90.0% with the inclination percentage of 51.0–80.1%, edge concentration is reduced to a level of no practical problem. If the inclination percentage is 0.5–51.5%, the edge concentration is completely removed. (2) If the duty percentage is 80.0 and 70.0% with the inclination percentage of 52.5–82.5%, edge concentration is reduced to a level of no practical problem. If the inclination percentage is 0.5–52.5%, the edge concentration is completely removed. (3) If the duty percentage is 60.0%, 50.0% and 40.0% with the inclination percentage of 55.0–85.0%, edge concentration is reduced to a level of no practical problem. If the inclination percentage is 0.5–55.0%, the edge concentration is completely removed. (4) If the duty percentage is 30.0% and 20.0% with the inclination percentage of 57.5–87.5%, edge concentration is reduced to level of no practical problem. If the inclination percentage is 0.5–57.5%, the edge concentration is completely removed. (5) If the duty percentage is 10.0% and 5.0% with the inclination percentage of 59.5–89.5%, edge concentration is reduced to a level of no practical problem. If the inclination percentage is 0.5–59.5%, the edge concentration is completely removed.

In the case that m/s is 1.5 mg/cm$^2$, (1) if the duty percentage is 95% and 90.0% with an inclination percentage of 46.5–76.5%, edge concentration is reduced to a level of no practical problem. If the inclination percentage is 0.5–46.5%, the edge concentration is completely removed. (2) If the duty percentage is 80.0% and 70.0% with the inclination percentage of 49.0–79.0%, edge concentration is reduced to a level of no practical problem. If the inclination percentage is 0.5–49.0%, the edge concentration is completely removed. (3) If the duty percentage is 60.0%, 50.0% and 40.0% with the inclination percentage of 52.5–82.5%, edge concentration is reduced to a level of no practical problem. If the inclination percentage is 0.5–52.5%, the edge concentration is completely removed. (4) If the duty percentage is 30.0% and 20.0% with the inclination percentage of 56.5–86.5%, edge concentration is reduced to a level of no practical problem. If the inclination percentage is 0.5–56.5%, the edge concentration is completely removed. (5) If the duty percentage is 10.0% and 5.0% with the inclination percentage of 59.0–89.0%, edge concentration is reduced to a level of no practical problem. If the inclination percentage is 0.5–59.0%, the edge concentration is completely removed.

The foregoing is the results of experiments.

FIG. 36 shows a relationship between the inclination percentage and the duty percentage in one period of the alternating component of the developing bias voltage used in the experiments, and the state of occurrence of the edge concentration in the obtained 5 mm square image.

Similarly, the toner coating amount m/s was changed in a range of 0.2–1.5 mg/cm$^2$, and the duty percentage was changed in the range of 5.0%–95.0%. For the respective duty percentages, the inclination percentage was changed in the range of 0.5%–99.5%.

As will be understood from FIG. 31, in the case that the toner coating amount m/s is not less than 0.35 mg/cm$^2$, insufficient density of the image is reduced to a level of no practical problem for all duty percentages ranging from 5.0–95.0% if the inclination percentage is 10.0–20.0%. If the inclination percentage is 20.0–99.5%, the image density is sufficient.

In the case that m/s is 0.30 mg/cm$^2$, (1) if the duty percentage is 95.0% and 90.0% with the inclination percentage of 10.3–20.3%, insufficient density is reduced to a level of no practical problem. If the inclination percentage is not less than 20.3%, the image density is sufficient. (2) If the duty percentage is 80.0% and 70.0%, with the inclination percentage of 10.8–20.8%, insufficient density is reduced to a level of no practical problem. If the inclination percentage is not less than 20.8%. the image density is sufficient. (3) If the duty percentage is 60.0%, 50.0% and 40.0% with the inclination percentage of 11.5–21.5%, insufficient density is reduced to a level of no practical problem. If the inclination percentage is not less than 21.5%, the image density is sufficient. (4) If the duty percentage is 30.0% and 20.0% with the inclination percentage of 12.3–22.3%, insufficient density is reduced to a level of no practical problem. If the inclination percentage is not less than 22.3%, the image density is sufficient. (5) If the duty percentage is 10.0 and 5.0% with the inclination percentage of 12.6–22.6%, insufficient density is reduced to a level of no practical problem. If the inclination percentage is not less than 22.6%, the image density is sufficient.

In the case that m/s is 0.25 mg/cm$^2$, (1) if the duty percentage is 95% and 90.0% with the inclination percentage of 10.7–20.7%, insufficient density is reduced to a level of no practical problem. If the inclination percentage is not less than 20.7%, the image density is sufficient. (2) If the duty percentage is 80.0 and 70.0% with the inclination percentage of 11.5–21.5%, insufficient density is reduced to a level of no practical problem. If the inclination percentage is not less than 21.5%, the image density is insufficient. (3) If the duty percentage is 60.0%, 50.0% and 40.0% with the inclination percentage of 12.8–22.8%, insufficient density is reduced to a level of no practical problem. If the inclination percentage is not less than 2.8%, the image density is sufficient. (4) If the duty percentage is 30.0% and 20.0% with the inclination percentage of 14.3–24.3 %, insufficient density is reduced to a level of no practical problem. If the inclination percentage is not less than 24.3%, the image density is sufficient. (5) If the duty percentage is 10.0% and 5.0% with the inclination percentage of 15.3–25.3%, insufficient density is reduced to a level of no practical problem. If the inclination percentage is not less than 25.3%, the image density is sufficient.

In the case that m/s is 0.2 mg/cm$^2$, (1) if the duty percentage is 95% and 90.0% with the inclination percentage of 11.01–21.0%, insufficient density is reduced to a level of no practical problem. If the inclination percentage is not less than 21%, the image density is sufficient. (2) If the duty percentage is 80.0% and 70.0% with the inclination percentage of 12.0–22.0%, insufficient density is reduced to a level of no practical problem. If the inclination percentage is not less than 22.0%, the image density is sufficient. (3) If the duty percentage is 60.0%, 50.0% and 40.0% with the inclination percentage of 14.0–24.0%, insufficient density is reduced to a level of no practical problem. If the inclination percentage is not less than 24.0%, the image density is sufficient. (4) If the duty percentage is 30.0% and 20.0% with the inclination percentage of 16.5–26.5%, density insufficient is reduced to a level of no practical problem. If the inclination percentage is not less than 26.5%, the image density is sufficient. (5) If the duty percentage is 10.0% and 5.0% with the inclination percentage of 17.0–27.0%, insufficient density is reduced to a level of no practical problem. If the inclination percentage is not lees than 27%, the image density is sufficient.

The foregoing is the results of experiments.

As will be understood from FIGS. 35 and 36, the inclination percentage (%)=A=T11/T1×100, and the duty percentage (%)=B=T1/(T1+T2)×100, are determined on the basis of the toner application amount m/s, as follows:

When 0.6 mg/cm$^2$≦m/s≦1.5 mg/cm$^2$ $10.0 \leqq A \leqq (-16.7 \times m/s + 10.0) \times B/100 + 90.0$ When 0.35 g/cm$^2$≦m/s≦0.6 mg/cm$^2$, $10.0 \leqq A \leqq 90.0$ When 0.2 mg/cm$^2$≦m/s≦0.35 mg/cm$^2$ $-(-53.3 \times m/s + 18.7) \times (B/100 - 1.0) + 10.0 \leqq A \leqq 90.0$ By doing so, images without edge concentration or insufficient image density could be provided without toner scattering and electric discharge.

Preferably,

When 0.6 mg/cm$^2$≦m/s≦1.5 mg/cm$^2$ $20.0 \leqq A \leqq (-16.7 \times m/s + 10.0) \times B/100 + 60.0$ When 0.35 g/cm$^2$≦m/s≦0.6 mg/cm$^2$, $20.0 \leqq A \leqq 60.0$ When 0.2 mg/cm$^2$≦m/s≦0.35 mg/cm$^2$ $-(-53.3 \times m/s + 18.7) \times (B/100 - 1.0) + 20.0 \leqq A \leqq 60.0$ The reasons are not clear, but similarly to the foregoing, according to the regulated falling bias voltage, the reciprocating motion, in the SD gap, of the toner particles having different charge amounts is controlled by the falling period of the AC component of the developing bias voltage, so that toner reciprocation in the wide end portion of the SD gap can be prevented for all of the toner particles irrespective of the charge amount of the toner, and therefore, the toner can be sufficiently reciprocated in the narrow central portion of the SD gap. Accordingly, edge concentration and insufficient density can be prevented in the developed image. In addition, edge concentration and insufficient image density can be suppressed through the following mechanism.

Generally speaking, the mirror force Fm of the toner to the developing sleeve is expressed as follows:

$$Fm \propto Q^2/r^2$$

where the charge amount of the toner particle is Q, and a distance between the center of a toner particle and the surface of the developing sleeve is r.

Therefore, if the toner application amount m/s on the developing sleeve, that is, the toner layer thickness, is increased, the toner adjacent the surface part of the toner layer receives small mirror force Fm from the developing sleeve, since the distance r from the surface of the developing sleeve increases. Therefore, the toner can move from the developing sleeve to the photosensitive drum even when the potential difference between the photosensitive drum and the developing sleeve is small, and the developing electric field in the SD gap is small.

FIG. 37 shows a relationship between a moving period of the toner toward the photosensitive drum from the developing sleeve at an end portion of the SD gap, when the regulated falling bias voltage applied to the developing sleeve is different.

Referring to FIG. 37, in the case that the coating amount of the toner m/s is large, the toner tc in the case of the large coating amount starts to move from the developing sleeve to the photosensitive drum when the potential of the developing sleeve becomes Va. If the coating amount of the toner m/s is small, the toner td in the case of the large coating amount starts to move from the developing sleeve to the photosensitive drum when the potential of the developing sleeve become Vb. When a developing bias voltage B1 having a large inclination percentage indicated by a solid line in FIG. 37 is used, the moving periods of the toner tc in the case of the large coating amount and the toner td in the case of the small coating amount, are Tc1 and Td1. When the developing bias voltage B1 is used, the toner td in the case of the small coating charge amount does not result in edge concentration, but the toner tc in the case of the large coating amount has a longer moving period Ta1, and therefore, edge concentration occurs. For this reason, for the toner tc in the case of the large coating amount, the developing bias voltage B2 having a small inclination percentage indicated by the broken in FIG. 37 is desirably used. By doing so, the toner moving period for the toner tc is shortened from Tc1 to Tc2. Then, the production of edge concentration of the image can be prevented.

When the rising period of the developing bias voltage is long, as shown by broken line in FIG. 30, the moving period of the toner tc having a small charge amount becomes longer with the result of toner reciprocation occurring at the end of the SD gap so that edge concentration occurs. For this reason, a shorter rising period is preferable.

FIG. 38 shows a relationship between a moving period of the toner from the developing sleeve toward the photosensitive drum in the central portion of the SD gap when the regulated falling bias voltage applied to the developing sleeve is different.

Referring to FIG. 38, when the coating amount of the toner m/s is large, the toner tc in the case of the large coating amount starts to move from the developing sleeve to the photosensitive drum when the potential of the developing sleeve becomes Va. When the coating amount of the toner m/s is small, the toner td in the case of the small coating amount starts to move from the developing sleeve to the photosensitive drum when the potential of the developing sleeve becomes Vb. When a developing bias voltage B4 having a small inclination percentage is used as indicated by a solid line in FIG. 38, the moving periods of the toner tc in the case of the large coating amount and the toner td in the case of the small coating amount, are Tc4 and Td4. With the developing bias voltage B4, the toner td in the case of the large coating amount does not result in insufficient image density, but the toner td in the case of the small coating amount has a shorter moving period Td4, and therefore, toner reciprocation is insufficient, and therefore, insufficient image density occurs. For this reason, for the toner td in the case of the large coating amount, a developing bias voltage B3 having a large inclination percentage indicated by a broken line in FIG. 38 is desirably used. By doing so, the toner moving period for the toner td can be made longer from Td4 to Td3, and therefore, insufficient image density of the image can be prevented from occurring.

From the foregoing, in this embodiment, the time period of the regulated falling bias voltage (C) and the time period of the toner transferring step (B) with the potential of Vmax, are optimized in consideration of the toner application amount m/s on the developing sleeve, so that the image density can be increased without electric discharge and toner scattering.

Embodiment 9

In this embodiment, a regulated falling bias voltage having a stepwise waveform for the falling part of the bias voltage is used, as shown in FIG. 4 (Embodiment 3). The regulated bias voltage satisfies the conditions in Embodiment 8. The application amount of the black toner (CLC200) layer the developing sleeve m/s was 0.4 mg/cm$^2$. This embodiment is the same as Embodiment 8 in other respects.

As a result, images without edge concentration and insufficient image density could be provided without spark discharge and toner scattering or the like. As will be understood, the regulated falling bias voltage is not limited to a rectilinear voltage, and the effects of the present invention are still provided.

In this embodiment, the waveform of the falling voltage of the regulating falling part is in the form of a step, but it may be a sine wave, rectangular wave, sawtooth wave, triangular wave, exponential wave or logarithmic wave or the like, with the same advantageous effect. The waveform in the rising step may be a sine wave or the like.

As shown in FIG. 4, the waveform in the transfer step (B) with the potential of Vmax and the waveform in the back-transfer step (A) with the potential of Vmin, are preferably rectilinear. However, if the flattened by reducing the amplitude, a sine wave or a rectangular wave or the like can be used with the same advantageous effects.

Embodiment 10

In this embodiment, the color image forming apparatus shown in FIG. 5 (Embodiment 4) is used, and the developing devices 12*a*–12*d* are incorporated the present invention.

In this embodiment, similarly to Embodiment 6, a toner layer having the application amount m/s of 0.4 mg/cm$^2$ is formed using an elastic blade 7*a*–7*d* on the developing sleeves 2*a*–2*d* of the developing devices 12*a*–12*d* in FIG. 5.

The regulated falling bias voltage part of the developing bias had a frequency of 1000 Hz, Vdc of −200 V, an amplitude of 1600 V, a duty percentage of 30%, an inclination percentage of 66.7%, so as to satisfy the conditions described in conjunction with Embodiment 8.

The other conditions of this embodiment were the same as in Embodiment 4. As a result, a color image without edge concentration or insufficient image density could be provided without toner scattering and discharge.

As in Embodiment 4, the developing device of the image forming apparatus may be a rotary type developing device 12 using developing unit cartridges 12*a*–12*d*, as shown in FIG. 6, wherein the rotary type developing device 12 is rotated by a cartridge selection mechanism, so that the developing devices 12*a*–12*d* are moved to a developing position faced to the photosensitive drum 1.

The color image was formed through a method in which toner images having different colors are superposed onto the transfer material. However, as shown in FIG. 7, the toner images of the different colors may be formed on the photosensitive drum 1. Alternatively, as shown in FIG. 8, the toner images of different colors may be transferred onto an intermediate transfer member 16.

In any case, a color image without edge concentration or density insufficiency can be formed without toner scattering and discharging.

As described in the foregoing, according to Embodiments 8–10, the developing bias used is in the form of superposed DC and AC voltages to be applied to the developer carrying member in the developing operation, and the falling part of the developing bias voltage is regulated. In addition, the inclination percentage and the duty percentage in the falling step in one period or cycle of the AC component of the bias voltage, is on the basis of the toner coating amount m/s. This is effective to provide good images without edge concentration or density insufficiency, without toner scattering and discharging.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

a developer carrying member, disposable opposite an image bearing member, for carrying a developer;

electric field forming means for forming, between an image bearing member and said developer carrying member, an alternating electric field including alternatingly repeating a first electric field having a constant intensity for a predetermined period for directing developer toward the image bearing member and a second electric field having a constant intensity for a predetermined period for directing developer toward said developer carrying member;

wherein a transition of the alternating electric field from the first electric field to the second electric field is substantially sharp, and a transition of the alternating electric field from the second electric field to the first electric field is substantially gradual.

2. An apparatus according to claim 1, wherein a duration T11 of the first electric field and a time T12 required for the electric field to transition from the first electric field to the second electric field satisfy the equation:

$$10.0 \leqq T11/(T11+T12) \times 100 \leqq 90.0.$$

3. An apparatus according to claim 2, wherein the duration T11 of the first electric field and the time T12 required for the electric field to transition from the first electric field to the second electric field satisfy the equation:

$$20.0 \leqq T11/(T11+T12) \times 100 \leqq 60.0.$$

4. An apparatus according to claim 1, further comprising image forming apparatus for forming a full-color image by laminating magenta, cyan and yellow toners.

5. An apparatus according to claim 1, wherein said electric field forming means applies a developing bias voltage oscillating at a predetermined frequency to a developer carrying member.

6. An apparatus according to claim 1, wherein the developer is a one-component toner, and wherein a toner layer thickness on said developer carrying member at a developing position is smaller than a gap formed between the image bearing member and said developer carrying member.

7. An apparatus according to claim 1, wherein a duration T11 of the first electric field, a time T12 required for the electric field to transition from the first electric field to the second electric field, an amount of charge q/m (μc/g) per unit mass of a toner which is a one-component toner, and a frequency T of the alternating electric field, where B=(T11+T12)/T×100, satisfy the equations:

when $6.0 \leqq |q/m| \leqq 18.0$ $10.0 \leqq T11/(T11+T12)\times 100 \leqq -(-1.25 \leqq |q/m|+22.5)\times B/100+90.0$ when $18.0 \leqq |q/m| \leqq 26.0$ $10.0 \leqq T11/(T11+T12)\times 100 \leqq 90.0$ when $26.0 \leqq |q/m| \leqq 35.0$ $(-0.89\times|q/m|+18.7)\times(B/100-1.0)+10.0 \leqq T11/(T11+T12)\times 100 \leqq 90.0$.

8. An apparatus according to claim 7, wherein the following equations are satisfied:

when $6.0 \leqq |q/m| \leqq 18.0$ $20.0 \leqq T11/(T11+T12)\times 100 \leqq -(-1.25\times|q/m|+22.5)\times B/100+60.0$ when $18.0 \leqq |q/m| \leqq 26.0$ $20.0 \leqq T11/(T11/T12)\times 100 \leqq 60.0$ when $26.0 \leqq |q/m| \leqq 35.0$ $(-0.89\times|q/m|+18.7)\times(B/100-1.0)+20.0 \leqq T11/(T11+T12)\times 100 \leqq 60.0$.

9. An apparatus according to claim 1, wherein a duration T11 of the first electric field, a time T12 required for the electric field to transition from the first electric field to the second electric field, an amount m/s (mg/cm$^2$) of developer on a surface of the developer carrying member per unit area, and a frequency T of the alternating electric field, where B=(T11+T12)/T×100, satisfy the following equations:

$10.0 \leqq T11/(T11+T12)\times 100 \leqq 90.0$, and when $0.6 \leqq m/s \leqq 1.5$ $10.0 \leqq T11/(T11+T12)\times 100 \leqq (-16.0\times m/s+10.0)\times B/100+90.0$ when $0.35 \leqq m/s \leqq 0.6$ $10.0 \leqq T11/(T11+T12)\times 100 \leqq 90.0$ when $0.2 \leqq m/s \leqq 0.35$ $-(-53.3\times m/s+18.7)\times(B/100-1.0)+10.0 \leqq T11/(T11+T12)\times 100 \leqq 90.0$.

10. An apparatus according to claim 9, wherein the following equations are satisfied:

when $0.6 \leqq m/s \leqq 1.5$ $20.0 \leqq T11/(T11+T12)\times 100 \leqq (-16.7\times m/s+10.0)\times B/100+60.0$ when $0.35 \leqq m/s \leqq 0.6$ $20.0 \leqq T11/(T11+T12)\times 100 \leqq 60.0$ when $0.2 \leqq m/s \leqq 0.35$ $-(-53.3\times m/s+18.7)\times(B/100-1.0)+20.0 \leqq T11/(T11+T12)\times 100 \leqq 60.0$.

11. An apparatus according to claim 1, wherein the transition from the first electric field to the second electric field is linear.

12. An apparatus according to claim 1, wherein a gap formed between the image bearing member and said developer carrying member is larger at a downstream end portion of a developing zone than at a central portion thereof in a direction toward completion of a development operation.

* * * * *

UNITED STATES PATENT AND TRADEMARK OFFICE

CERTIFICATE OF CORRECTION

PATENT NO. : 5,678,130

DATED : October 14, 1997

INVENTOR(S) : ENOMOTO ET AL.

It is certified that error appears in the above-identified patent and that said Letters Patent is hereby corrected as shown below:

Column 1

Line 61, "2" rubbed"should read --2 is rubbed--.

Column 2

Line 40, "are" should read --is--.

Column 3

Line 34, "sane" should read --sine--.

Column 4

Line 42, "Without" should read --without--; and
Line 44, "show" should read --shown--.

Column 5

Line 61, "portion By" should read --portion Rb. By--.

Column 6

Line 37, "Sleeve" should read --sleeve--.

Column 7

Line 31, "toter" should read --toner--;
Line 34, "sufficiently the" should read --sufficiently in the--; and
Line 49, delete "of", and "on toner" should read --on the toner--.

UNITED STATES PATENT AND TRADEMARK OFFICE

CERTIFICATE OF CORRECTION

PATENT NO. : 5,678,130

DATED : October 14, 1997

INVENTOR(S) : ENOMOTO ET AL.

It is certified that error appears in the above-identified patent and that said Letters Patent is hereby corrected as shown below:

Column 8

Line 22, delete "the"; and
Line 37, delete "with the".

Column 9

Line 3, "Inclination" should read --inclination--; and
Line 25, "T1/(T1+T2×100" should read --T1/(T1+T2)×100--.

Column 10

Line 5, "tuner" should read --toner--.

Column 11

Line 37, "reveres" should read --reverse--; and

Column 12

Line 36, "|q/m →" should read --|q/m|--.

Column 13

Line 19, "Is" should read --is--.

Column 14

Line 7, "is" should read --are--.

UNITED STATES PATENT AND TRADEMARK OFFICE

CERTIFICATE OF CORRECTION

PATENT NO. : 5,678,130

DATED : October 14, 1997

INVENTOR(S) : ENOMOTO ET AL.

It is certified that error appears in the above-identified patent and that said Letters Patent is hereby corrected as shown below:

Column 15

Line 23, "is" should read --are--.

Column 16

Line 19, "FIG. 38" should read --FIG. 30--.

Column 18

Line 30, "are" should read --is--; and
Line 48, "increased an" should read --increased to an--.

Column 20

Line 18, "is" should read --are--;
Line 22, delete "the" (third occurence).

Column 21

Line 34, "is" should read --are--.

Column 22

Line 42/43, "the broken in" should read --the broken line in--.

UNITED STATES PATENT AND TRADEMARK OFFICE

CERTIFICATE OF CORRECTION

PATENT NO. : 5,678,130 Page 4 of 4

DATED : October 14, 1997

INVENTOR(S) : ENOMOTO ET AL.

It is certified that error appears in the above-identified patent and that said Letters Patent is hereby corrected as shown below:

Column 23

Line 46, "the flattened" should read --the waveform is flattened--; and

Line 52, "incorporated the" should read --incorporated in the --.

Signed and Sealed this

Thirty-first Day of March, 1998

*Attest:*

*Attesting Officer*

Bruce Lehman

BRUCE LEHMAN

*Commissioner of Patents and Trademarks*